United States Patent [19]

Sasaki et al.

[11] Patent Number: 4,705,744

[45] Date of Patent: Nov. 10, 1987

[54] COLOR PHOTOGRAPHIC MATERIALS HAVING RED COLOR SATURATION AND IMPROVED DISCRIMINATION OF GREEN COLORS

[75] Inventors: Noboru Sasaki, Odawara; Koji Takahashi, Hadano, both of Japan

[73] Assignee: Fuji Photo Film Co., Ltd., Minami-ashigara, Japan

[21] Appl. No.: 751,961

[22] Filed: Jul. 5, 1985

[30] Foreign Application Priority Data

Jul. 6, 1984 [JP] Japan ..... 59-140240

[51] Int. Cl.[4] ..... G03C 1/46; G03C 7/00

[52] U.S. Cl. ..... 430/505; 430/362; 430/504; 430/506; 430/554; 430/957

[58] Field of Search ..... 430/506, 504, 505, 554, 430/957, 362

[56] References Cited

U.S. PATENT DOCUMENTS

| | | | |
|---|---|---|---|
| 3,811,890 | 5/1974 | Ohta et al. | 430/504 X |
| 3,990,899 | 11/1976 | Shiba et al. | 430/382 X |
| 4,306,015 | 12/1981 | Haylett | 430/382 |
| 4,477,563 | 10/1984 | Ichijima et al. | 430/544 |
| 4,500,634 | 2/1985 | Sakanoue et al. | 430/555 X |
| 4,564,587 | 1/1986 | Watanabe et al. | 430/506 X |

FOREIGN PATENT DOCUMENTS

| | | |
|---|---|---|
| 0114675 | 8/1984 | European Pat. Off. . |
| 2530645 | 1/1976 | Fed. Rep. of Germany . |
| 1252066 | 11/1971 | United Kingdom . |

*Primary Examiner*—John E. Kittle
*Assistant Examiner*—Mukund J. Shah
*Attorney, Agent, or Firm*—Burns, Doane, Swecker & Mathis

[57] ABSTRACT

Silver halide color photographic materials comprising a support having thereon at least one blue-sensitive silver halide emulsion layer comprising a yellow dye-forming coupler, at least one green-sensitive silver halide emulsion layer comprising a magenta dye-forming coupler, and at least one red-sensitive silver halide emulsion layer comprising a cyan dye-forming coupler, characterized in that the wavelength weight-averaged between 500 nm and 600 nm ($\lambda_G$) of spectral sensitivity distribution of all green-sensitive layers is in the range of 520 nm to 580 nm, the wavelength weight-averaged between 500 nm and 600 nm ($\lambda_{-R}$) of spectral sensitivity distribution of one or more donor layers which exert an interlayer effect to at least one red-sensitive emulsion layer comprising a cyan dye-forming coupler is located in the range of 500 nm to 560 nm, and the difference of ($\lambda_G - \lambda_{-R}$) is greater than 5 nm.

The silver halide color photographic materials provide excellent saturation of red colors and improved discrimination of various green colors.

21 Claims, 7 Drawing Figures

COLOR PHOTOGRAPHIC MATERIALS HAVING RED COLOR SATURATION AND IMPROVED DISCRIMINATION OF GREEN COLORS

BACKGROUND OF THE INVENTION (1) Field of the Invention

This invention relates to color photographic materials which provide a color image having good color reproduction and improved sharpness.

(2) Description of the Prior Art

The use of the interlayer restraining effect has been known as a useful means for improving color reproduction of color photographic materials. In color negative photographic materials, for instance, the development restraining effect from green-sensitive layers to red-sensitive layers may restrain color formation in the red-sensitive layer upon white light exposure to a greater extent than upon red light exposure. In a color negative film-color paper system, gradation is balanced so that an area exposed by white light reproduces neutral gray on a color print, and therefore the interlayer effect leads to greater cyan dye-formation in an area exposed by red light than in an area exposed by white light. As a result, the interlayer effect caused in the color negative film affords a color print of decreased cyan dye-formation, that is, reproducing highly saturated red color. Similarly, a development restraining effect from red-sensitive layers to green-sensitive layers leads to reproduction of green colors having higher saturation.

One method for increasing the interlayer effect so far known is a method using iodide ion released upon development from a silver halide emulsion. In this method, the silver iodide content of the donor layer of the interlayer effect is high, while the silver iodide content of the receptor layer is low. Another method for increasing the interlayer effect is, as described in Japanese Patent Application (OPI) (unexamined published application) No. 50-2537, one in which the donor layer of the interlayer effect includes a coupler which reacts with the oxidation products of a paraphenylenediamine type color developer to release a development restraining compound. Still another method for increasing the interlayer effect is one called an auto-masking method in which a colored coupler is incorporated in an uncolored coupler-containing layer to mask unwanted absorption of the colored dye produced upon development from the uncolored coupler. According to this method, it is possible to obtain a similar effect to the interlayer effect by increasing the amount of the colored coupler incorporated so that masking is effected to a greater extent than that necessary to mask the unwanted absorption of the colored dye produced from the uncolored coupler.

It is known that iodide ion which contributes to the development restraint and a development restrainer released from a development inhibitor-releasing (DIR) compound gives rise to not only the interlayer effect but also the Eberhard effect by diffusing also in the direction perpendicular to incident lights to improve image sharpness. As described in European Pat. No. 101,621 and Japanese Patent Application (OPI) No. 59-131934, the Eberhard effect is particularly remarkable if the development restrainer or its precursor has a high diffusibility. It is now becoming common in the field of photography to incorporate such DIR compounds into photographic materials to greatly increase the image shapness thereof.

In order to emphasize a contrast of fine lines at ten cycles per millimeter on a film by the Eberhard effect, it is necessary for the restrainer or its precursor to diffuse tens of microns during development, which is comparable to the total film thickness of the photographic materials swollen in the processing liquid. This means that the development restrainer would exert an effect on all the photographic layers of the photographic materials, which would cause the following adverse problems: In order to increase image sharpness, it is necessary to increase the diffusibility of the development restrainer or a precursor thereof. However, as the diffusibility becomes high, the interlayer development restraining effect also becomes high, which makes it difficult to control the direction and the extent of the development restraining effect. For example, if the DIR compound is incorporated into a blue-sensitive silver halide emulsion layer so as to have a desired interlayer effect from the blue-sensitive layer to a green-sensitive layer, the interlayer effect reaches also to a red-sensitive layer to such an extent that color reproduction becomes undesirable. It is therefore eagerly desired to solve the problem.

The inventors of the this invention have found that the incorporation of a DIR compound which releases a development restrainer having high diffusibility into a green-sensitive layer increases both the saturation of red color and the image sharpness of the green-sensitive layer which is the visually most important layer because the human eye has the highest sensitivity in the green region of the spectrum. They have also found that the incorporation of the DIR compound has a disadvantage in reproduction of green colors. Various green colors having different hue such as yellow-green, orange-green, cyan-green, brownish green, etc. which the human eye can discriminate, become colors of a cyan tint similar to each other on a color print which the human eye can no longer discriminate. They have studied and found the causes of such phenomenon as follows:

When the large interlayer effect is given from a green-sensitive layer to blue-sensitive and red-sensitive layers, the longer wavelength region of the spectral sensitivity distribution curve for the blue-sensitive layer and the shorter wavelength region of the spectral sensitivity distribution curve for the red-sensitive layer are made less sensitive by the interlayer effect as shown in FIG. 1, resulting in the substantial loss of the sensitivities of the blue-sensitive and the red-sensitive layers in the region of the spectrum which overlaps by the green-sensitive region. As a result, only the green-sensitive layer produces green dye but the blue-sensitive and the red-sensitive layers do not produce any color dye when the light sensitive materials are exposed to light having any wavelength within this green region. In other words, only the green-sensitive layer produces color dye when the interlayer effect from the green-sensitive layer is too large so as to completely inhibit the possible development in the blue-sensitive and/or the red-sensitive layers. This is the reason why green objects having different maximum absorption wavelength ($\lambda max$) are liable to appear in a single green color as the color reproduced and consequently to worsen the discrimination of green colors having different hue.

SUMMARY OF THE INVENTION

An object of the present invention is to provide color photographic materials providing excellent saturation of red colors and improved discrimination of various green colors.

Another object of the present invention is to provide color photographic materials which are capable of improving the problems caused by the use of compounds releasing a development restrainer or a precursor thereof having high diffusibility, i.e., the problems caused by an emulsion layer having large interlayer effects.

Another object of the present invention is to provide color photographic materials providing excellent image sharpness of green-sensitive, red-sensitive and blue-sensitive layers, high saturation of red colors and excellent discrimination of green colors having different hue.

The above-described objects have been accomplished by silver halide color photographic materials comprising a support having thereon at least one blue-sensitive silver halide emulsion layer comprising a yellow dye-forming coupler, at least one green-sensitive silver halide emulsion layer comprising a magenta dye-forming coupler, and at least one red-sensitive silver halide emulsion layer comprising a cyan dye-forming coupler, charactrerized in that the wavelength weight-averaged between 500 nm and 600 nm ($\bar{\lambda}_G$) of spectral sensitivity distribution of all green-sensitive layers is located in the range of 520 to 580 nm, the wavelength weight-averaged between 500 nm and 600 nm ($\bar{\lambda}_{-R}$) of spectral sensitivity distribution of one or more donor layers which exert an interlayer effect to at least one red-sensitive emulsion layer comprising a cyan dye-forming coupler is located in the range of 500 nm to 560 nm, ($\bar{\lambda}_G$) is greater than ($\bar{\lambda}_{-R}$), and the difference of ($\bar{\lambda}_G - \bar{\lambda}_{-R}$) is greater than 5 nm: wherein said weight-averaged wavelength ($\bar{\lambda}_G$) is defined by the following equation:

$$\bar{\lambda}_G = \frac{\int_{500\,nm}^{600\,nm} \lambda \cdot S_G(\lambda)\, d\lambda}{\int_{500\,nm}^{600\,nm} S_G(\lambda)\, d\lambda}$$

wherein $S_G(\lambda)$ is the spectral sensitivity distribution by equi-energy spectrum of all green-sensitive layers, and said weight-averaged wavelength ($\bar{\lambda}_{-R}$) is defined by the following equation:

$$\bar{\lambda}_{-R} = \frac{\int_{500\,nm}^{600\,nm} \lambda \cdot S_{-R}(\lambda)\, d\lambda}{\int_{500\,nm}^{600\,nm} S_{-R}(\lambda)\, d\lambda}$$

wherein $S_{-R}(\lambda)$ represents the spectral sensitivity distribution of said one or more donor layers.

The relative value of $S_G(\lambda)$ at a specific wavelength ($\lambda$) can be found at the point (a) in FIG. 2A.

The weight-averaged wavelength ($\bar{\lambda}_{-R}$) of the wavelength distribution of the interlayer effect received by at least one red-sensitive silver halide emulsion layers in the range of 500 nm to 600 nm can be determined as follows:

(1) The cyan dye-forming red-sensitive layer which is sensitive to radiation having a wavelength longer than 600 nm is uniformly exposed through a red filter (which transmits only radiation to which the red-sensitive layer is sensitive and to which the other layers are insensitive) or an interference filter (which transmits only radiation having a spcific wavelength) to uniformly fog the cyan dye-forming red-sensitive layer to an appropriate optical density near the maximum density.

(2) The equi-energy spectral exposure is made to cause the interlayer development restraining effect on the fogged red-sensitive emulsion layer from the blue-sensitive and the green-sensitive layers. As a result, a reversal image is obtained (see FIG. 2B).

(3) From this reversal image, the spectral sensitivity distribution $S_{-R}(\lambda)$ as a reversal photographic material is found. The relative value of $S_{-R}(\lambda)$ at a specific wavelength ($\lambda$) can be found at the point (b) in FIG. 2B.

(4) The weight-averaged wavelength ($\bar{\lambda}_{-R}$) of the interlayer effect is calculated according to the above-described equation.

| cyan density necessary for the complete color reproduction | |
|---|---|
| ---□-□--- | Sample 101 |
| —○—○— | Sample 102 |
| --- Δ-Δ --- | Sample 103 |
| -∘-●-●-∘- | Sample 104 |
| ---◎-◎--- | Sample 106 |
| ---▲-▲--- | Sample 107 |

Figure 1:
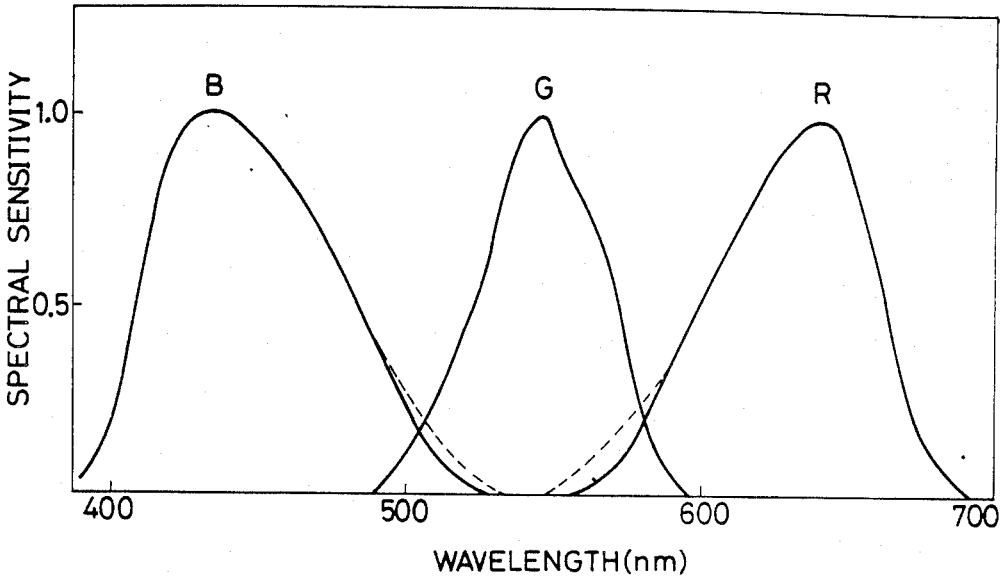
FIG. 1 shows spectral sensitivity distribution curves by equi-energy spectrum for a normal color photographic material. The dotted lines show the curves in a case where the interlayer effect from a green-sensitive layer to a red- or blue-sensitive layer is small, while the solid lines show the curves in a case where the interlayer effect is large. B, G and R denote the curves for the blue-, green- and red-sensitive layers, respectively.
Figure 5:
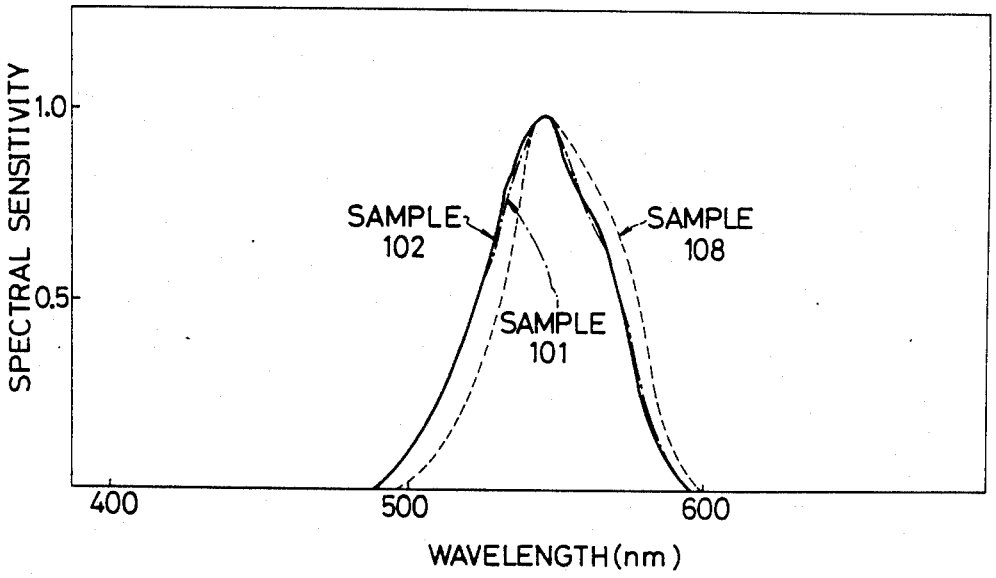
Figure 2A:
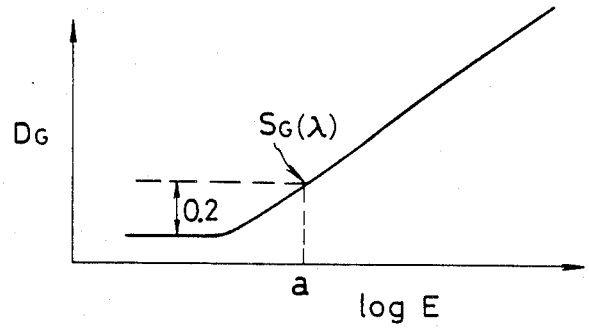
FIG. 2A shows a characteristic curve for the green-sensitive layer(s) at a specific wavelength ($\lambda$).
Figure 2B:
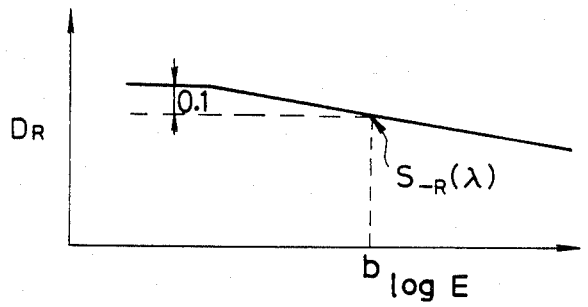
FIG. 2B shows a characteristic curve for a reversal image of the red-sensitive layer(s) produced by the interlayer effect from the one or more donor layers.

FIG. 5 shows spectral sensitivity distribution curves for Samples 101, 102 and 108.

| | |
|---|---|
| -∘-•-∘- | Sample 101 |
| ——— | Sample 102 |
| ------- | Sample 108 |

Figure 6:
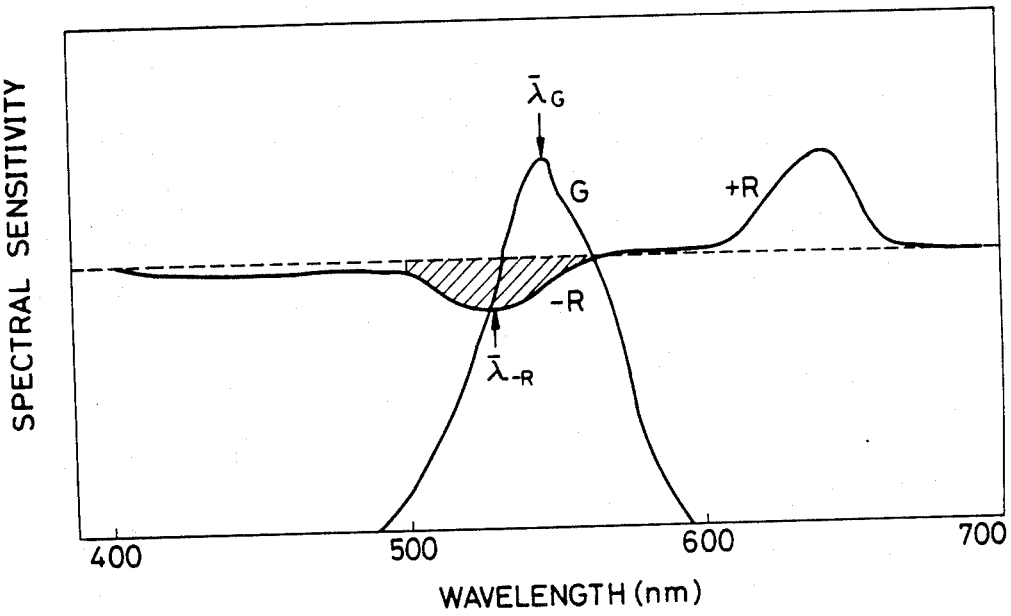

FIG. 6 shows a spectral sensitivity distribution curve for green-sensitive layers(s) (G) and spectral sensitivity distribution curve for one or more donor layers which exert an interlayer effect to red-sensitive layer(s) (−R represents a restraining or reversed sensitivity curve), with the spectral sensitivity as the ordinate and wavelength as the abscissa. For details of $\bar{\lambda}_G$ and $\bar{\lambda}_{-R}$, see detailed description.

DETAILED DESCRIPTION OF THE INVENTION

U.S. Pat. No. 4,306,015 (Japanese Patent Application (OPI) No. 54-118245) discloses a method for effecting the interlayer effect at any desired wavelength. This method comprises spectrally sensitizing with a sensitizing dye a photographic silver halide emulsion layer (a donor layer) which releases a development restrainer and in which substantially no photographic image is present, and providing the photographic silver halide emulsion layer adjacent, directly or through an intermediate layer, to a silver halide emulsion layer (an acceptor layer) by which the interlayer effect is to be received. This method has the advantage in that coarse grain emulsion can be used without the loss of the granularity because the donor layer of the interlayer effect does not yield a color dye. It has been found preferable that the donor layer(s) possesses after processing a photographic image having essentially the same color as the image of the layers other than the acceptor layer has when the donor layer is spectrally sensitive outside the spectrally sensitive region of the acceptor layer. This preference stems from the fact that an image having an excellent sharpness can be obtained. The mechanism of the improved sharpness is speculated that when the donor layer yields a photographic image, this image has a good sharpness owing to a strong Eberhard effect and overlaps the photographic image in said layers other than the donor and acceptor layers to give an final image of excellent sharpness.

It has also been found preferable that one or more donor layers which exert an interlayer effect to at least one red-sensitive emulsion layer comprising a cyan dye forming-couplers comprises one or more uncolored coupler selected from a magenta dye-forming coupler or a yellow dye-forming coupler which yellow or magenta dyes are not capable of being washed out nor capable of being destroyed during the development processing.

When the DIR compound used in the donor layer is one as disclosed in U.S. Pat. No. 4,005,634 which releases a highly diffusible development restrainer, the development restraining effect reaches all layers, wherever the donor layer is present in a multi-layer photographic element. It is therefore preferred that the donor layer yields a color dye image to correct the unwanted interlayer effect (e.g. it yields a dye of the same color as that of the dye produced in the layer which receives the undesired effect of the development restrainer). This further improves the sharpness and color reproduction of the final image.

The DIR compounds used in U.S. Pat. No. 4,306,015 release 1-phenyl-5-mercaptotetrazole as a development restrainer, which has low diffusibility as disclosed in U.S. Pat. No. 4,005,364, and therefore the interlayer effect of the development restrainer reaches only an emulsion layer(s) close to the layer containing the DIR compound. This means that the image sharpness is not greatly improved although there is no need for the compensation of unwanted color correction. This is also evident from the description, "The examples in this series represent the interposition of a donor layer (i.e. interposed between the first and second green layers) in a color negative tripack in such a way that it interacts only with the green" layer (i.e. it does not interact with the red layer), as set forth in column 14, lines 9 to 11 of U.S. Pat. No. 4,306,015.

The afore-mentioned objects of the present invention can be preferably accomplished by using, as a main component which gives rise to the interlayer effect, a DIR compound which releases a highly diffusible development restrainer or a precursor thereof and forming yellow and/or magenta color dye in the donor layer containing the DIR compound.

It should be noted that a photographic negative image is essentially present after development processing in one or more donor layers according to the present invention, whereas in the donor layer according to U.S. Pat. No. 4,306,015, essentially no photographic image is present after development processing as disclosed in Claim 1 and column 3, lines 9–13 thereof. By the term "essentially present" is meant that the reaction product(s) between the DIR coupler itself (and one or more uncolored image-forming couplers in combination therewith) and the oxidized color developer contributes at least 10%, preferably 15%, of the final density of the photographic material.

It is preferred that blue-sensitive, green-sensitive and red-sensitive silver halide emulsions of the photographic material of this invention are negative-working.

It is also preferred that only a negative color dye image is formed after color development processing of the photographic material of this invention.

This invention can concretely be brought to practice, for example, by the following embodiments. Light-sensitive layers of a standard color negative film is composed of at least two layers including a high-speed layer and a low-speed layer. The high-speed or low-speed layer is divided into further two layers, one of which is sensitized to the normal spectrum region having the weight-averaged wavelength of about 555 nm, the other of which (donor layer) is spectrally sensitized to the spectrum region having the weight-averaged wavelength of about 515 nm and the DIR compound just described above is added to the latter layer. Preferably, an uncolored magenta dye-forming coupler and/or and uncolored yellow dye-forming coupler is added to each of the two layers so as to obtain a gray balance on white light exposure. In this case, $\bar{\lambda}_{-R}$ is 515 nm, $\bar{\lambda}_G$ is 555 nm and $\bar{\lambda}_G-\bar{\lambda}_{-R}$ is 40 nm. As seen from the ranges of $\bar{\lambda}_G$ and $\bar{\lambda}_{-R}$ as defined above, possible values of $\bar{\lambda}_G-\bar{\lambda}_{-R}$ are between 5 nm and 80 nm and are preferably between 10 nm and 80 nm, more preferably between 20 nm and 60 nm.

The donor layer which contains the DIR compound and is spectrally sensitized to the spectrum region having the weight-averaged wavelength of, e.g. 515 nm may be placed in any position on a support and it is preferably placed between a yellow filter and the support. It is more desirable to place this donor layer uppermore in a green-sensitive unit (i.e. remote from the support) because the emulsion layer becomes more sensitive because of the absence of the absorption by the other green-sensitive layer(s). This arrangement is very advantageous to the donor layer which is liable to be less sensitive and of lower gradation. In the preferred embodiment of this invention, the donor layer is placed between a yellow filter layer and a high-speed red-sensitive layer.

It is to be understood that it is necessary to place the DIR compound-containing layer more closely to a red-sensitive layer to ensure the interlayer effect on the red-sensitive layer, although it is disadvantageous in view of the sensitivity, if a development restrainer released from the DIR compound has low diffusibility.

In order to design a photographic material, the color reproduction of which is not greatly affected by the change of color temperature of the light source, it is desirable that the spectral sensitivity distribution of each of blue-, green- and red-sensitive layers be within the range as defined in Claim 1 of U.S. Pat. No. 3,672,898.

The effects of this invention are particularly remarkable when the weight-averaged wavelengths of spectral sensitivity distribution of blue-sensitive and red-sensitive layers are in the range of from 400 to 470 nm and from 600 to 650 nm, respectively.

The weight-averaged wavelengths of spectral sensitivity distribution of blue- and red-sensitive layers are defined by the following equations similar to that for $\overline{\lambda}_G$.

$$\overline{\lambda}_B = \frac{\int_{400\,nm}^{500\,nm} \lambda \cdot S_B(\lambda)\, d\lambda}{\int_{400\,nm}^{500\,nm} S_B(\lambda)\, d\lambda}$$

$$\overline{\lambda}_R = \frac{\int_{600\,nm}^{700\,nm} \lambda \cdot S_R(\lambda)\, d\lambda}{\int_{600\,nm}^{700\,nm} S_R(\lambda)\, d\lambda}$$

Preferable compounds which can be employed in this invention are those capable of releasing a development restrainer or a precursor thereof upon coupling with oxidized developer during development. They are represented by the following formula (I):

$$J\text{-}(Y)_h \qquad (I)$$

wherein J represents a coupler component, h represents an integer of 1 or 2 and Y represents a coupling-off group which is linked to a coupling position of the coupler component J and can be eliminated from the coupler component upon the reaction with the oxidation products of a color developing agent to form a highly diffusible development restrainer or a precursor thereof.

Preferable are DIR couplers capable of providing a development restrainer having a high diffusibility (measured by the method described later) of about 0.4 or more, and more preferably 0.6 or more.

Any J will do so long as it functions as a coupler and it is not always an essential property that J produces a dye by the coupling reaction. Preferably, J is a component of a compound that produces a magenta dye or a yellow dye, and more preferably a magenta dye.

In the formula (I), Y preferably represents a group of the formulas (II) to (V).

(II)

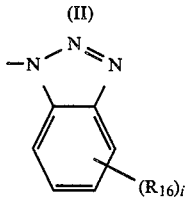

(III)

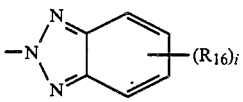

-continued (IV)

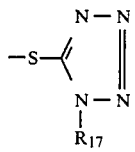

(V)

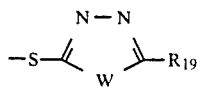

wherein W represents —S— or —N($R_{18}$)—, $R_{16}$, $R_{17}$, $R_{18}$ and $R_{19}$ each represents a group selected from a hydrogen atom, a bromine atom, an amino group, —R′, —NHCOR′, —NHSO$_2$R′, —OR′, —CO$_2$R′ and —NHR′ wherein R′ represents an aliphatic hydrocarbon group (substituted or not) having 1 to 8 carbon atoms or a phenyl group (substituted or not), $R_{16}$, $R_{17}$, $R_{18}$ and $R_{19}$ each is a group selected so that the development restrainer released from the compound of the formula (I) has a diffusibility of 0.4 or more, and i represents an integer of 1 to 4. A group represented by formulae (II) and (IV) is preferable.

Examples of the substituent $R_{16}$ include —CH$_3$ (i is 4 or less), —Br, —NHCOR′ wherein R′ has 3 to 7 carbon atoms, —NHSO$_2$R′ wherein R′ has 4 to 8 carbon atoms, —OR′ wherein R′ has 2 to 5 carbon atoms, —R′ having 1 to 3 carbon atoms,

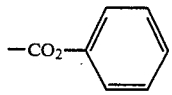

and —CO$_2$ R′ wherein R′ has 2 to 6 carbon atoms, wherein i is 1 if $R_{16}$ represents any substituent other than —CH$_3$, and —R′ is a substituted or unsubstituted, chain, cyclic or branched aliphatic group.

Examples of the substituent $R_{17}$ include ethyl, propyl, hydroxy-substituted phenyl, amino-substituted phenyl, sulfamoyl-substituted phenyl, carboxy-substituted phenyl, methoxycarbonyl-substituted phenyl, 3-methoxyphenyl, —(CH$_2$)$_{2-3}$ COOR′ wherein R′ has 2 to 3 carbon atoms

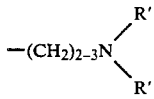

wherein two R′ may be the same or different and each R′ has 2 to 3 carbon atoms, —(CH$_2$)$_2$OCH$_3$, 3-carbamoylphenyl and 3-ureidophenyl and R′ is the same as defined for $R_{16}$. A lower alkyl group having a carbon number of 1 to 4 is particularly preferable as $R_{17}$.

Examples of $R_{18}$ include hydrogen and alkyl having 1 to 4 carbon atoms. Examples of $R_{19}$ include an amino group; —NHCOR′ wherein R′ has 1 to 6 carbon atoms;

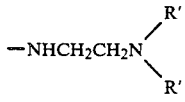

wherein R′ may be the same or different and represents methyl or ethyl; ethyl; propyl; —(CH$_2$)$_{2-3}$ COOH; and —(CH$_2$)$_{2-4}$ SO$_3$H.

Diffusibility of a development inhibitor is evaluated in the following manner, as disclosed in U.S. Pat. No. 4,500,634, column 8, lines 10 to 64.

On a transparent support, there are coated two layers having the following composition to make a light-sensitive material (SAMPLE B).

First layer: A red-sensitive silver halide emulsion layer

A gelatin coating solution which contains a silver bromoiodide emulsion (silver iodide: 5 mole %, average grain size: 4 microns) and Sensitizing Dye I ($6\times10^{-5}$ mole per mole of silver) used in Example 1 described later and added to render the emulsion red-sensitive, and coupler X (0.0015 mole per mole of silver) is coated on the support in the amount of 1.8 g silver/$m^2$ (2 microns in thickness).

Coupler X

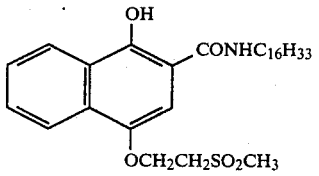

Second layer: A gelatin layer containing a silver bromoiodide emulsion which is the same as that used in the first layer except that it is not red-sensitized and polymethylmethacrylate matting particles having a diameter of about 15 microns (the amount of silver coated: 2 g/$m^2$, 1.5 microns in thickness).

In addition to the above compositions, each layer contains a gelatin hardener, a surface active agent, etc.

Sample A has the same construction as that of Sample B except that the second layer does not contain the silver bromoiodide emulsion.

Samples A and B are exposed to red-light through an optical wedge and developed in the same process as in Example 1 except that the time for development is 2 minutes 10 seconds. A development restrainer was added to the developer until the density of Sample A is reduced to ½. The degree of density reduction of Sample B developed in the developer containing such amount of the restrainer is a measure of diffusibility of the development restrainer in a silver halide emulsion layer.

In the formula (I), preferred examples of Y are represented by a group of the formula (VI).

—TIME—INHIBIT (VI)

wherein TIME is a group which is linked to a coupling position of a coupler and is cleaved upon the reaction with the oxidation products of a color developer to control properly the release of INHIBIT group after the cleavage.

The INHIBIT group is a residue of a development restrainer.

Preferred examples of the TIME group are those of the formulas (VII) to (XIII) as disclosed in U.S. Pat. No. 4,005,634.

Suitable examples of the yellow dye image forming coupler component represented by the group J in the formula (I) include those of pivaloylacetanilide, benzoylacetanilide, malonyldiester, molonylamide, dibenzoylmethane, benzothiazolylacetamide, malonic ester monoamide, benzthiazolylacetate, benzoxazolylacetamide, benzoxazolylacetate, benzimidazolylacetamide and benzimidazolylacetate types; those derived from hetero-ring substituted acetamide or hetero-ring substituted acetates as described in U.S. Pat. No. 3,841,880; those derived from acylacetamides as described in U.S. Pat. No. 3,770,446, British Pat. No. 1,459,171, West German Patent Application (OLS) No. 2,503,099, Japanese Patent Application (OPI) No. 50-139,738 or Research Disclosure No. 15737 (May, 1977); and hetero-ring type couplers as described in U.S. Pat. No. 4,046,574.

Preferable examples of a magenta dye image forming coupler component represented by the group J in the formula (I) include those of 5-oxo-2-pyrazoline nuclei, pyrazolo [1,5-a]benzimidazole nuclei and cyanoacetophenone type components.

Preferred examples of a cyan dye image forming coupler component represented by the group J include those of phenol nuclei and γ-naphthol nuclei.

Compounds which couple with the oxidation products of a developer to release a development inhibitor and to yield substantially no color dye are also useful as a DIR coupler in this invention. Examples of the group J of this type of coupler include those described in U.S. Pat. Nos. 4,052,213, 4,088,491, 3,632,345, 3,958,993 and 3,961,959.

Preferred examples of the group J of the formula (I) are those represented by the formulas (IA) to (IXA) as described in U.S. Pat. No. 4,005,634. More specifically, Compounds D-1 to D-47 as described in this patent are preferred.

Other specific examples as illustrated in U.S. Pat. No. 4,477,563 as Couplers (1) to (95) are also useful as DIR couplers of a donor layer. These DIR couplers release a development restraining moiety which is decomposed to a compound which does not substantially influence the photographic properties when the moiety diffuses into a color developing solution.

D-1

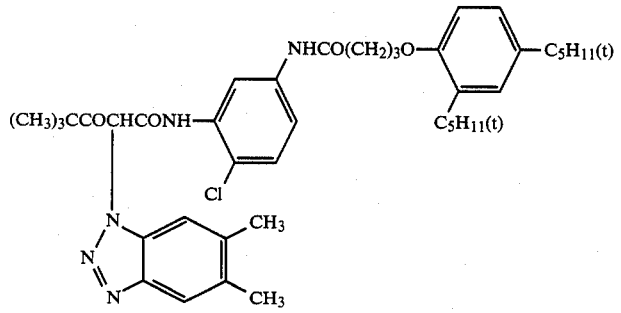

-continued
D-2
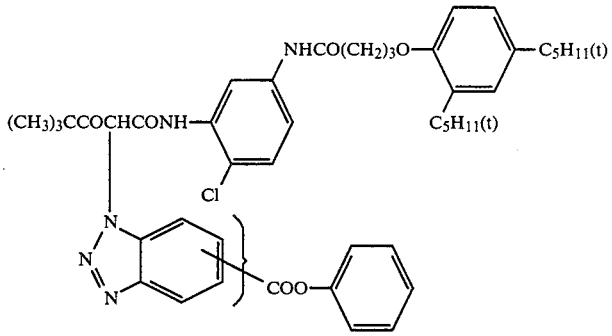
D-3
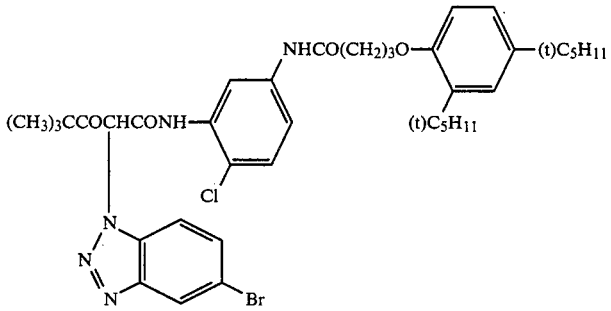
D-4
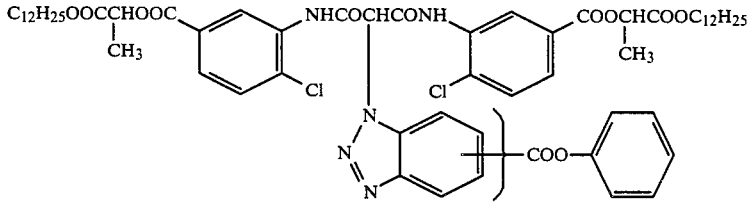
D-5
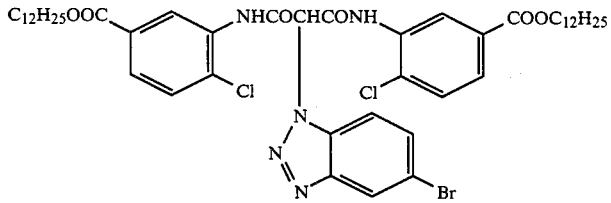
D-6
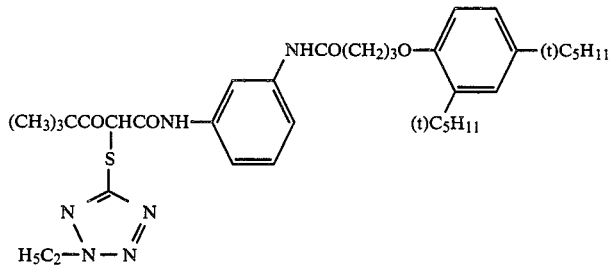

-continued
D-7
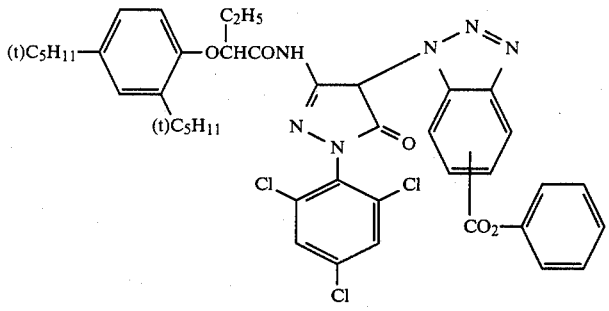
D-8
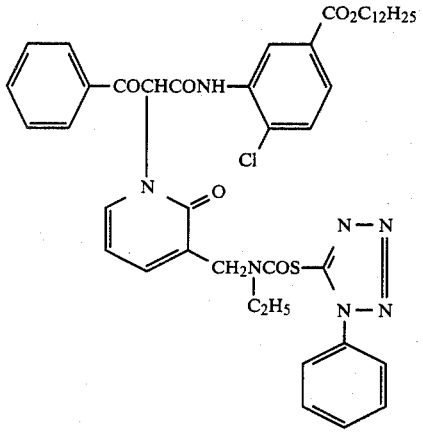
D-9
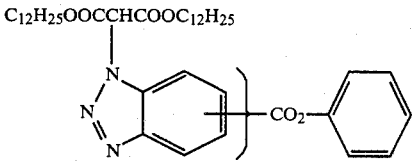
D-10
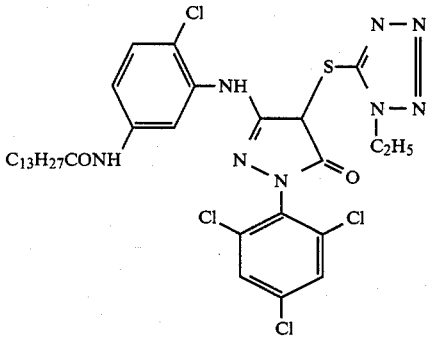
D-11
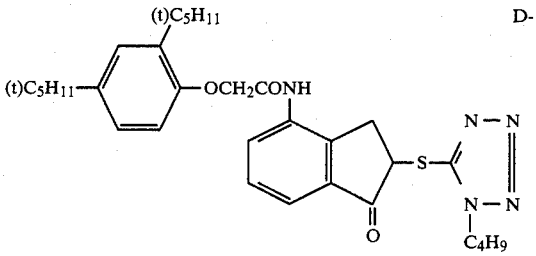
D-12
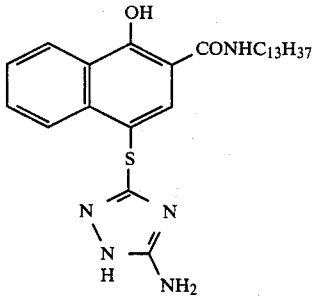
D-13
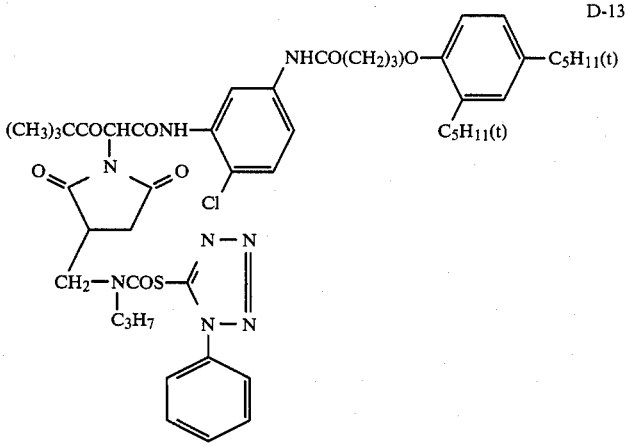

-continued
D-14
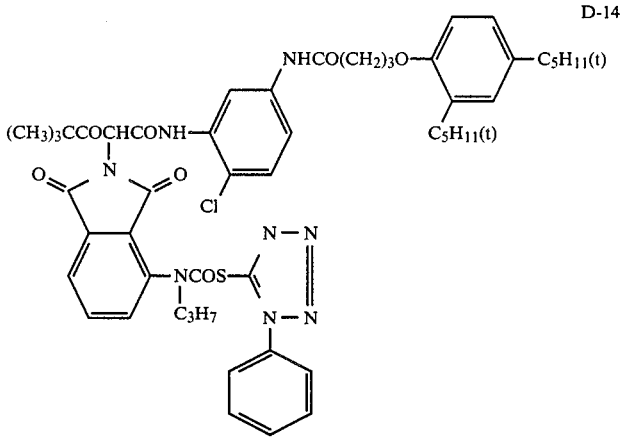
D-15
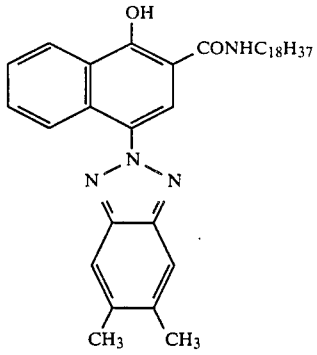
D-16
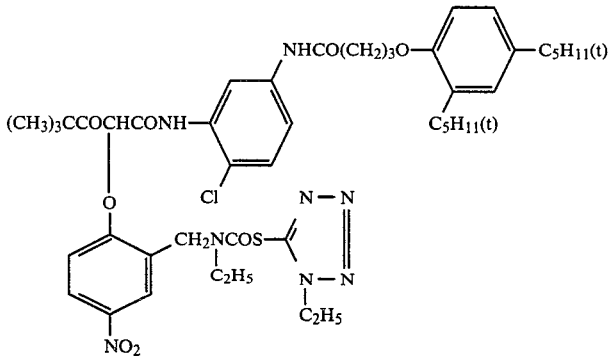
D-17
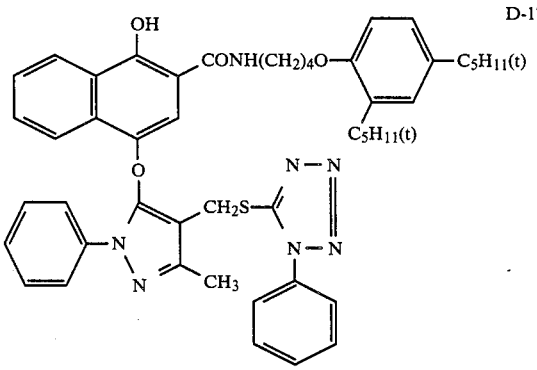
D-18
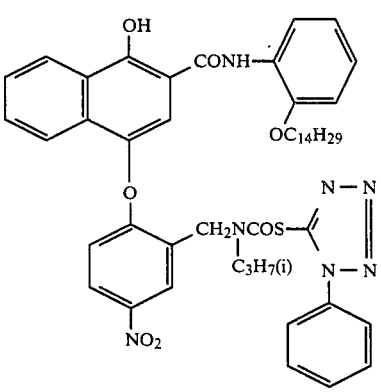
D-19
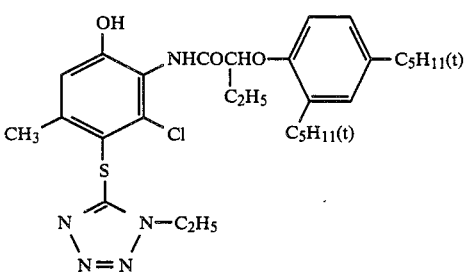
D-20
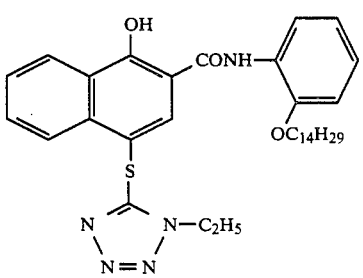

-continued
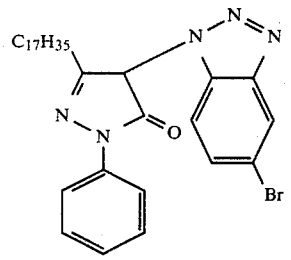
D-21
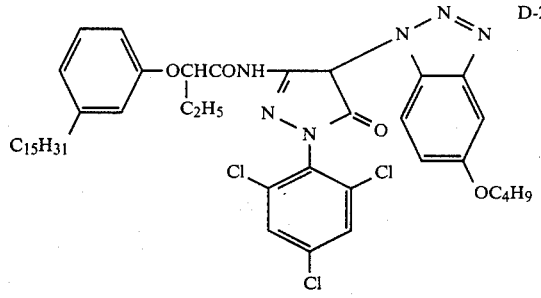
D-22
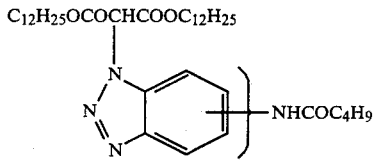
D-23
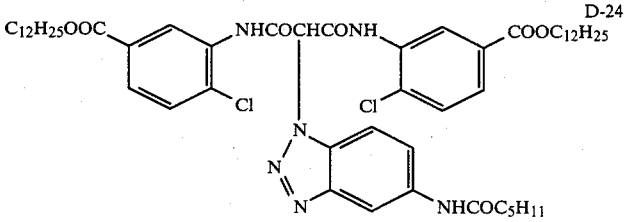
D-24
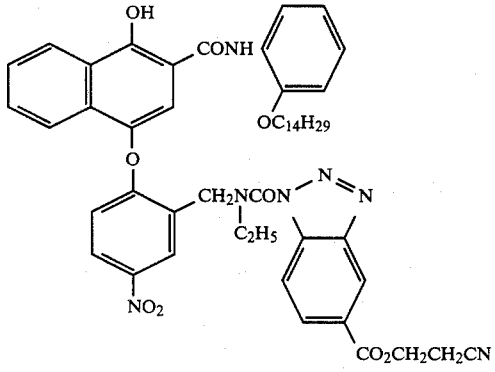
D-25
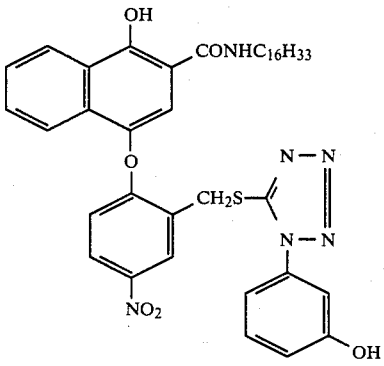
D-26
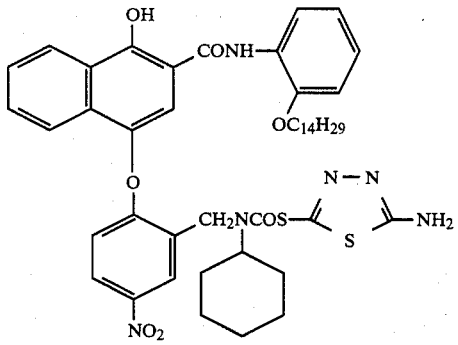
D-27
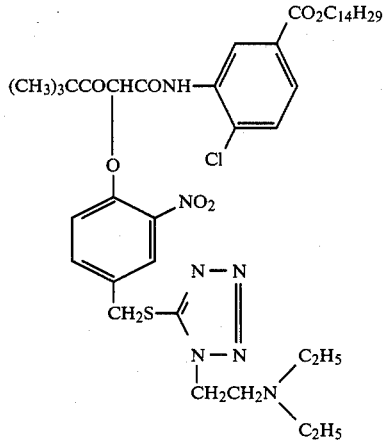
D-28

-continued
D-29
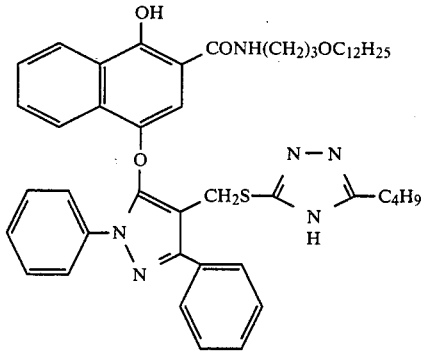
D-30
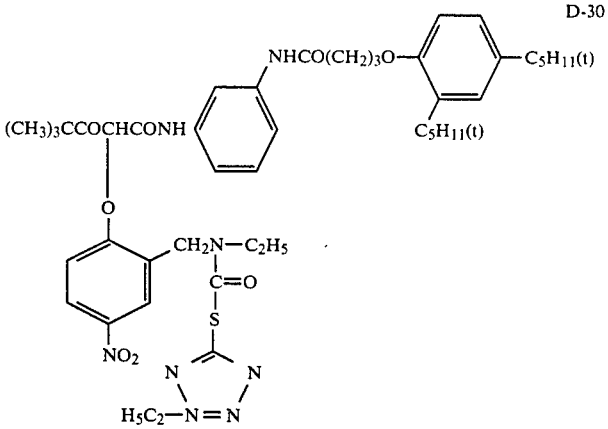
D-31
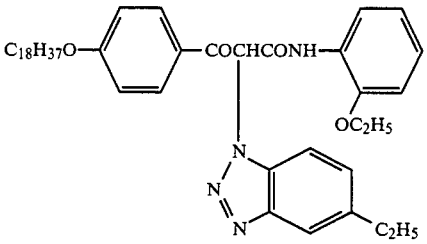
D-32
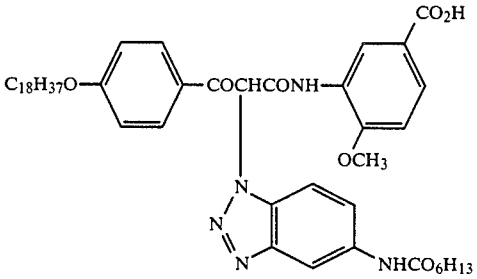
D-33
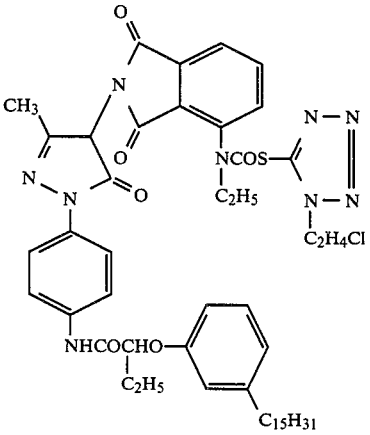
D-34
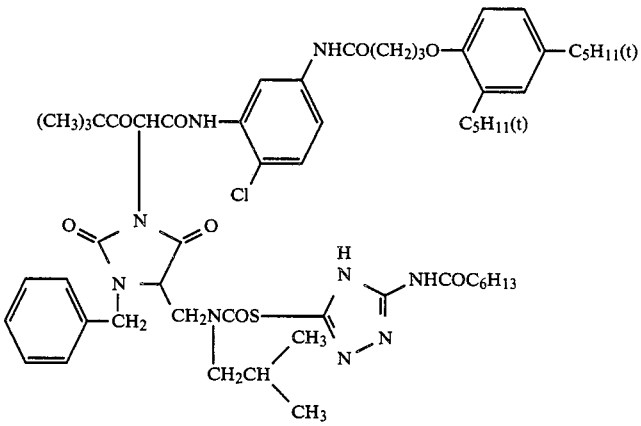

-continued
D-35
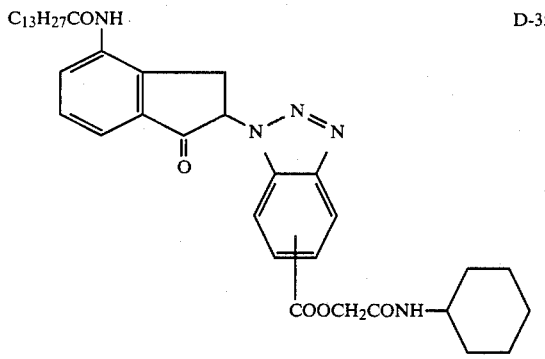
D-36
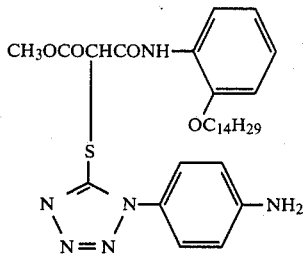
D-37
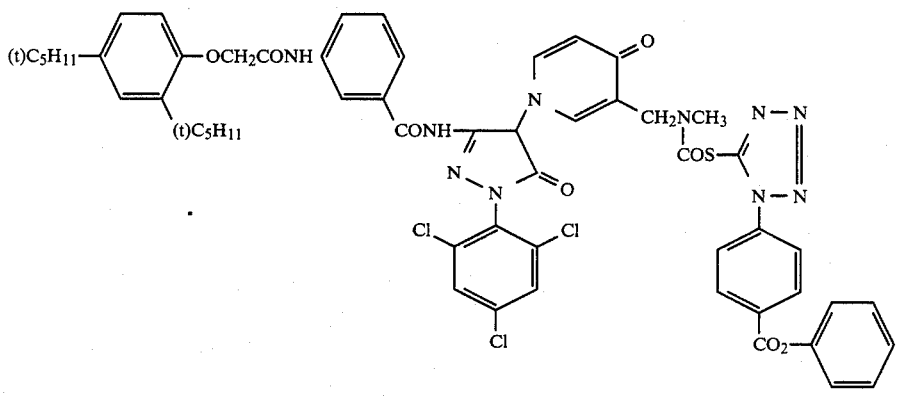
D-38
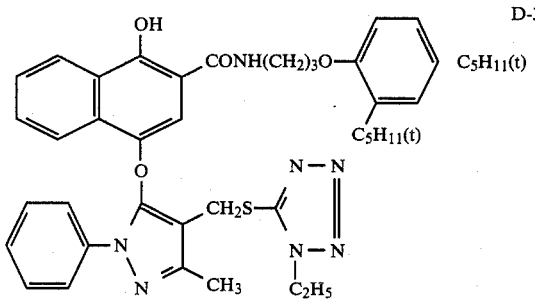
D-39
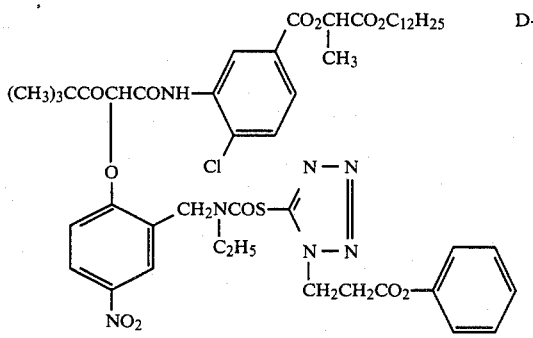
D-40
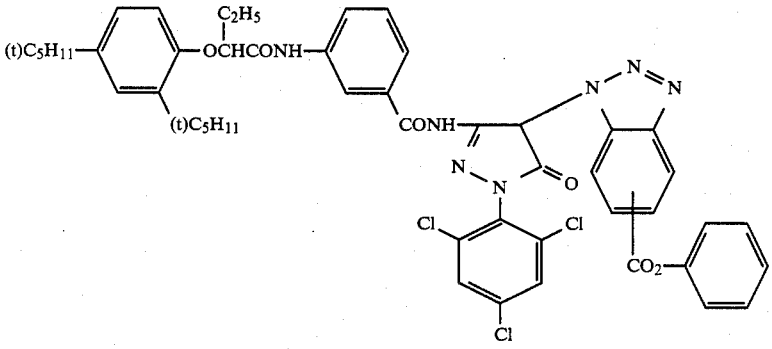

-continued
D-41
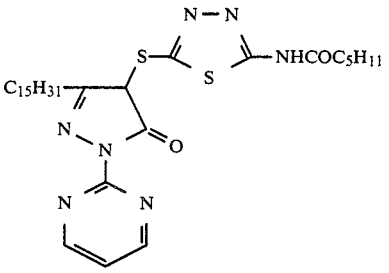
D-42
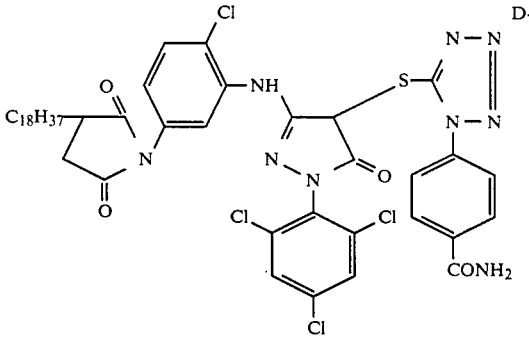
D-43
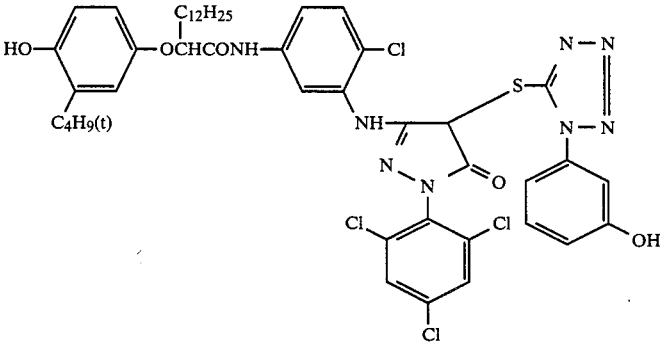
D-44
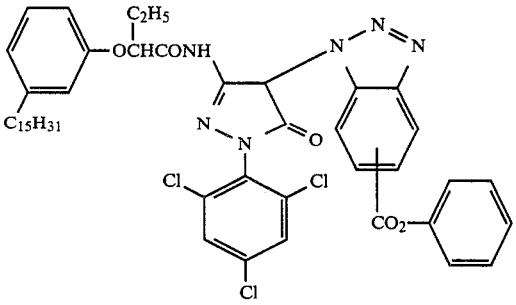
D-45
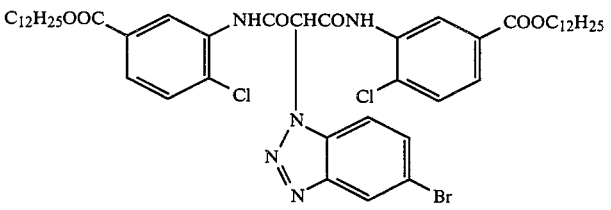
D-46
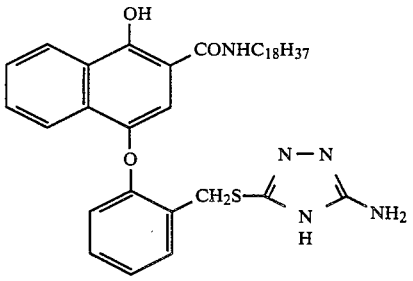
D-47
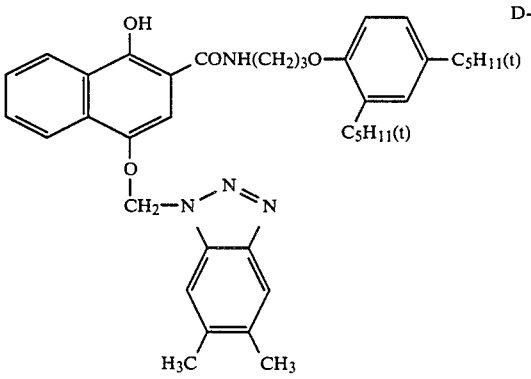
The spectral sensitivity of green-, blue- and red-sensitive emulsions used in this invention may be induced by known sensitizing dyes such as methine dyes. Such sensitizing dyes include cyanine dyes, merocyanine dyes, complex cyanine dyes, complex merocyanine dyes, holopolar cyanine dyes, hemicyanine dyes, styryl dyes and hemioxonol dyes. Especially useful dyes are cyanine dyes, merocyanine dyes and complex merocyanine dyes. In these dyes, there may be applied any nuclei conventionally used in cyanine dyes as basic heteroring nuclei such as pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus, etc.; these nuclei with which a hydrocarbon ring is fused; these nuclei with which an aromatic hydrocarbon ring is fused, i.e. indolenine nucleus, benzindolenine nucleus, indole nucleus, benzoxazole nucleus, naphthoxazole nucleus, benzothiazole nucleus, naphthothiazole nucleus, benzoselenazole nucleus, benzimidazole nucleus, quinoline nucleus, etc. These nuclei may be attached to a carbon atom.

In merocyanine dyes or complex merocyanine dyes, there may be applied, as a nucleus having ketomethylene structure, five or six member hetero-ring nuclei, such as, pyrazoline 5-on nucleus, thiohydantoine nucleus, 2-thiooxazolidine 2,4-dione nucleus, thiazolidine 2,4-dione nucleus, rhodanine nucleus, thiobarbituric acid nucleus.

These sensitizing dyes may be used alone or in combination, particularly for the purpose of supersensitization.

The weight-averaged wavelength $\bar{\lambda}_{-R}$ of the spectral sensitivity distribution $S_{-R}(\lambda)$ of an emulsion layer which effects the interlayer effect on a red-sensitive layer is preferably in the range of 500 nm to 550 nm, more preferably 500 nm to 530 nm. Sensitizing dyes which can be used are not limited to any particular ones and may be selected from the group described above. Preferred sensitizing dyes are those having an absorption maximum of 500 to 550 nm and more preferably of 500 to 530 nm. Preferred dyes are illustrated below. Dyes Nos. 37, 38 and 39 are usually used in combination with a sensitizing dye having the maximum absorption of longer wavelength to form the spectral sensitivity distribution $S_G(\lambda)$ of a green-sensitive layer. In order to form the spectral sensitivity distribution $S_{-R}(\lambda)$, it is preferred to use the dyes Nos. 37, 38 and 39 alone or in combination with a sensitizing dye having the maximum absorption of shorter wavelength.

SD-1

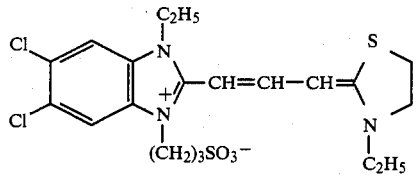

SD-2

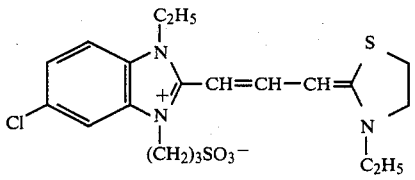

SD-3

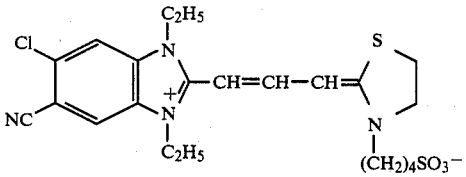

SD-4

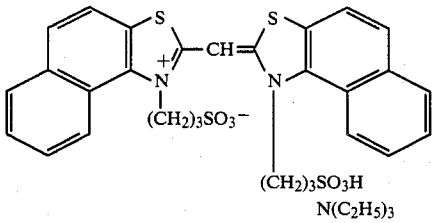

SD-5

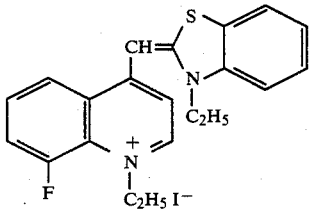

SD-6

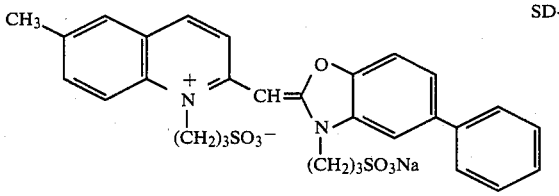

SD-7

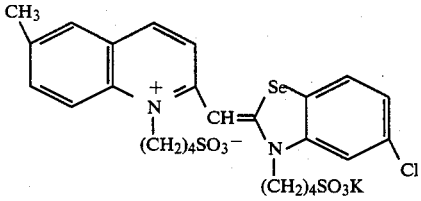

SD-8

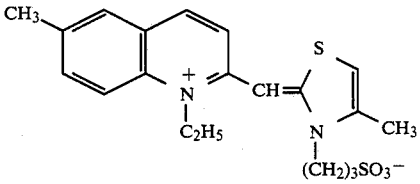

SD-9

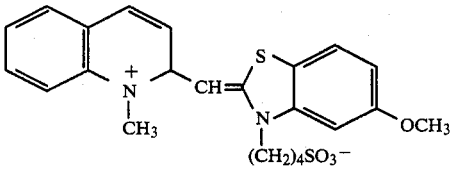

SD-10

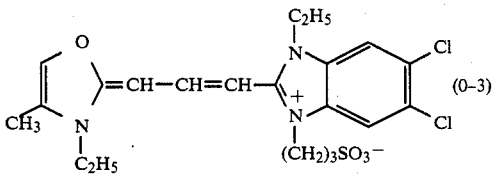

-continued
SD-11
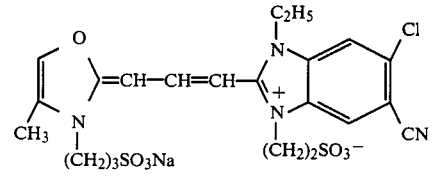
SD-12
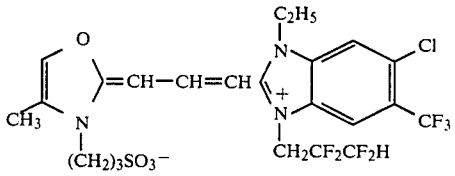
SD-13
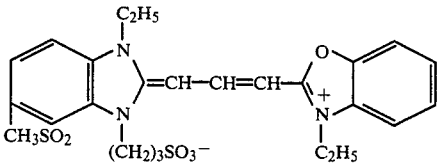
SD-14
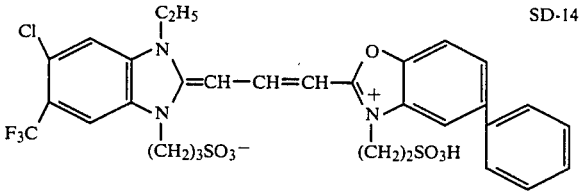
$N(C_2H_5)_3$
SD-15
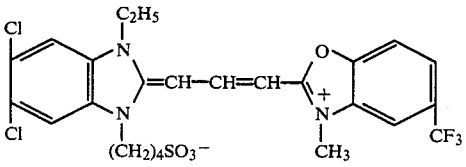
SD-16
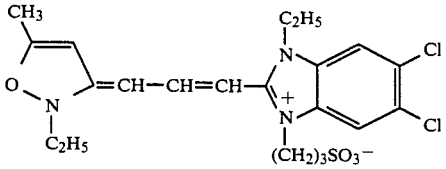
SD-17
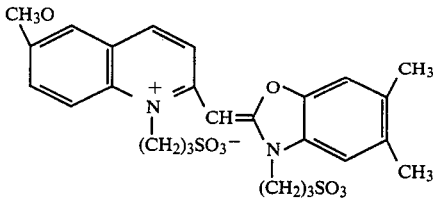
SD-18
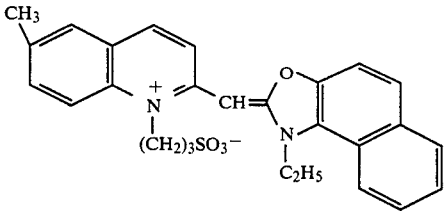
SD-19
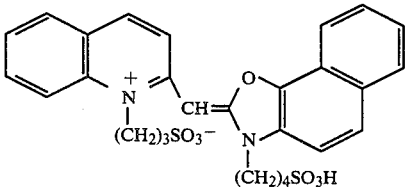
$N(C_2H_5)_3$
SD-20
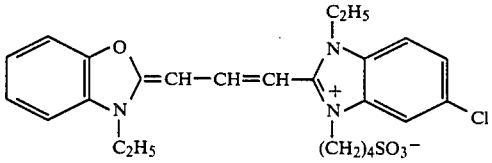
SD-21
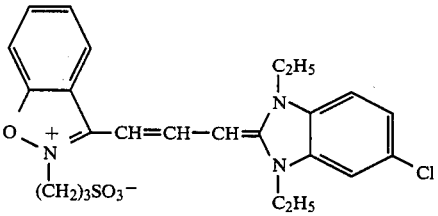
SD-22
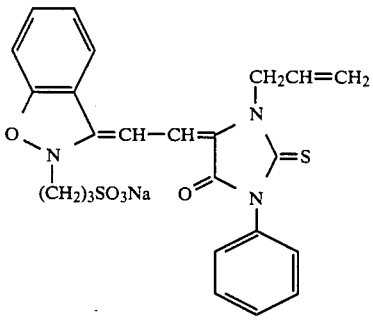
SD-23
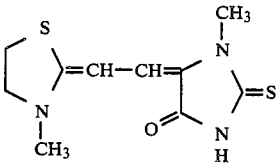
SD-24
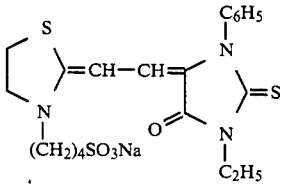

-continued
SD-25
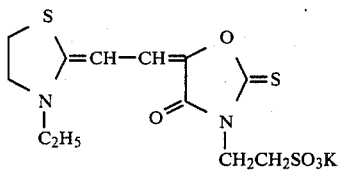
SD-26
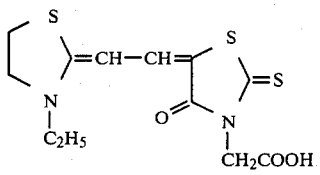
SD-27
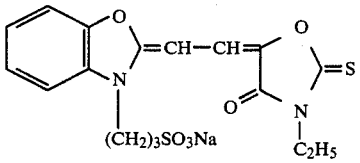
SD-28
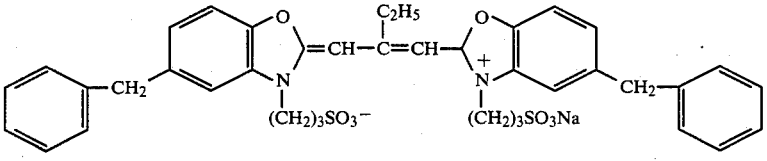
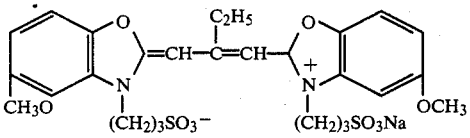
SD-29
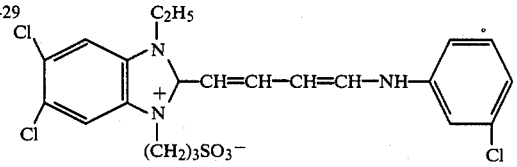
SD-30
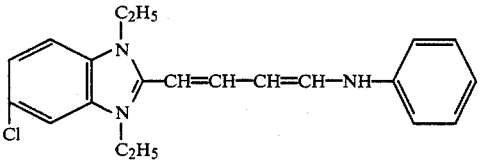
SD-31
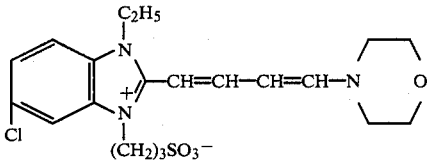
SD-32
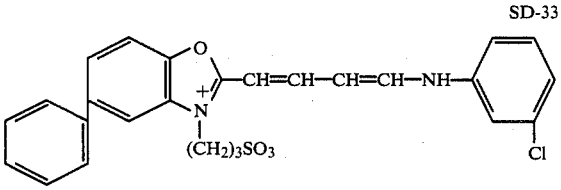
SD-33
SD-34
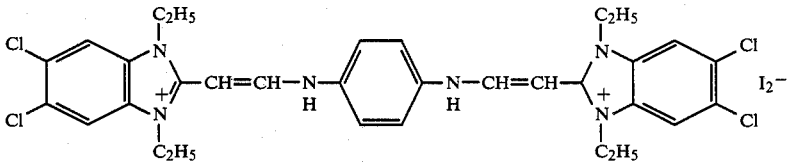
SD-35
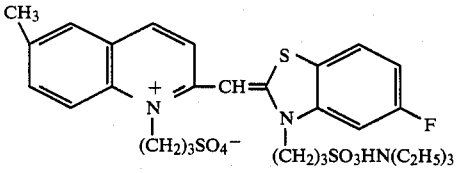
SD-36
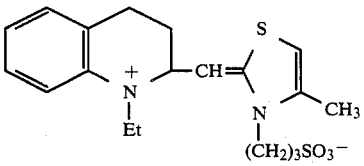

-continued

SD-37

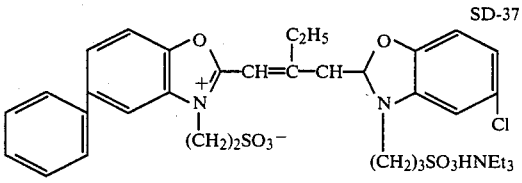

SD-38

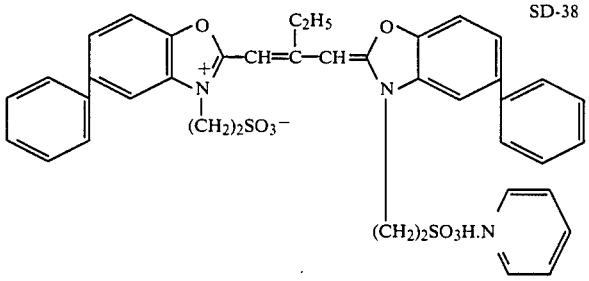

SD-39

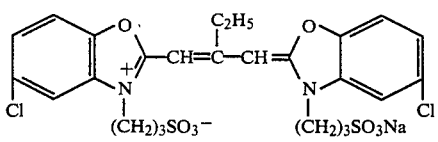

SD-40

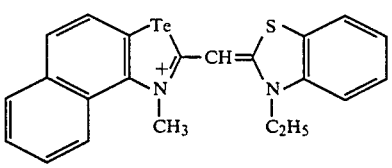

SD-41

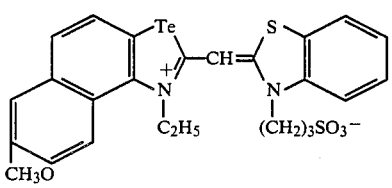

SD-42

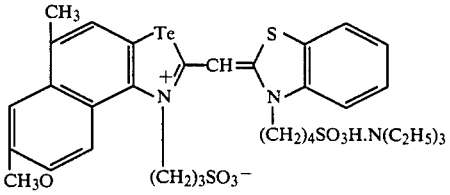

SD-43

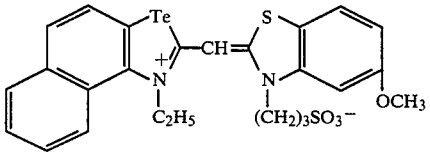

SD-44

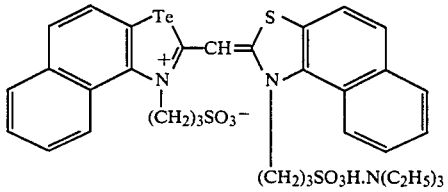

SD-45

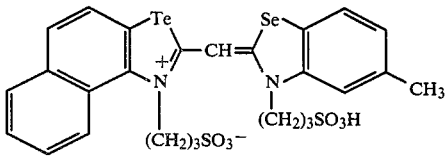

To the same or different photographic emulsion layers or light-insensitive layers of this invention, there may be incorporated alone or in combination, in addition to the compounds described above which form the highly diffusible development restrainer, etc., conventional DIR compounds which react with the coupling reaction products to release a development restrainer and to yield a color dye or colorless dye or other dye-forming couplers which react with the oxidation products of an aromatic primary amine developer such as phenylenediamine or aminophenol derivatives to form a color dye.

Examples of such couplers include magenta couplers, such as 5-pyrazolone couplers, pyrazolobenzimidazole couplers, pyrazoloimidazole couplers, pyrazolopyrazole couplers, pyrazolotriazole couplers, pyrazolotetrazole couplers, cyanoacetyl coumarone couplers and open chain acylacetonitrile couplers, etc.; yellow couplers, such as acylacetamide couplers (e.g., benzoylacetanilides, pivaloylacetanilides, etc.), etc.; and cyan couplers, such as naphthol couplers and phenol couplers, etc. It is preferable to use non-diffusible couplers containing a hydrophobic group (so-called a ballast group) within the molecule or polymeric couplers. They may be either 4-equivalent or 2-equivalent per mole of silver ion. It is also possible to use colored couplers capable of exerting color correction effects.

Two or more of these couplers may be included in a single layer or the same coupler may be incorporated in two or more eulsion layers so as to meet the characteristics of the photographic material to be made.

The couplers and other compounds described above can be incorporated in a silver halide emulsion layer by any conventional manner as described in, e.g. U.S. Pat. No. 2,322,027. For example, they are dissolved in a solvent such as phthalic acid alkyl esters (e.g. dibutyl phthalate, dioctylphthalate, etc.), phosphates (e.g. diphenyl phosphate, triphenyl phosphate, tricresyl phosphate, dioctyl butyl phosphate, etc.), citrates (e.g. tributyl acetylcitrate, etc.), benzoates (e.g. octyl benzoate), alkylamides (e.g. diethyllaurylamide), aliphatic acid esters (e.g. dibutoxyethyl succinate, diethyl azelate, dioctyl azelate, etc.), trimesic acid esters (e.g. trimesic acid tributyl ester), etc., or organic solvents having a boiling point of about 30° C. to about 150° C., such as lower alkyl acetates (e.g. ethyl acetate, butyl acetate), ethyl propionate, sec-butyl alcohol, methyl isobutyl ketone, 2-ethoxyethyl acetate, methylcellosolve acetate, etc. and then dispersed into a hydrophilic colloid. A mixture of these high and low boiling point solvents may also be used.

The dispersing method using the polymer as described in Japanese Patent Publication No. 51-39853 and Japanese Patent Application (OPI) No. 51-59943 may also be used.

Couplers having an acid group such as carboxyl or sulfonic may be introduced to a hydrophilic colloid in the form of an aqueous alkaline solution.

In this invention, the order of red-, green- and blue-sensitive emulsion layers can be varied. It is usual that cyan-, magenta- and yellow-dye forming couplers are incorporated in red-, green- and blue-sensitive emulsion layers, respectively, although other combinations are also possible.

Gelatin is most suitable as a binder or protective colloid used in emulsion layers or interlayers of the photographic material of this invention, although other hydrophilic colloids may be used alone or together with gelatin.

In this invention, both lime-processed gelatin and acid-processed gelatin may be used. Details of methods for the production of gelatin are described in Arther Veis, The Macromolecular Chemistry of Gelatin, Academic Press (1964).

In the emulsion layers of this invention, there may be used any of silver bromide, silver bromoiodide, silver bromochloroiodide, silver chlorobromide and silver chloride. A preferred silver halide is silver bromoiodide containing 15 mole % or less of silver iodide. A particularly preferred one is silver bromoiodide containing 2 to 12 mole % of silver iodide.

The average size of the silver halide grains of the photographic emulsion is not paricularly limited but it is preferably 3 microns or less, wherein the average grain size means the average diameter for spherical or nearly spherical grains and the average edge length for cubic grains and these average values are calculated from projected surface area.

The grain size distribution may be narrow or broad.

Silver halide grains in the photographic emulsion may be of regular forms such as cubic or octahedral grains, of irregular forms such as spherical or tabular grains, of complex forms thereof, or mixtures thereof.

There may also be used an emulsion wherein supertabular grains having a diameter-thickness ratio of at least five constitute 50% or more of the total projected area of silver halide grains.

The inner layer and the outer layer of silver halide grains may be different in phase. Silver halide grains may be those in which a latent image is formed mainly on the surface thereof, or those in which a latent image is formed mainly in the interior thereof.

The photographic emulsion used in this invention can be prepared in any manner, e.g., by the methods as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion.* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be used a method (so-called reversal mixing process) in which silver halide grains are formed in the presence of an excess of silver ions.

As one system of the double jet process, a so-called controlled double jet process in which the pAg in a liquid phase where silver halide is formed and maintained at a predetermined level can be employed. This process can produce a silver halide emulsion in which the crystal form is regular and the grain size is nearly uniform.

Two or more kinds of silver halide emulsions which are prepared separately may be used as a mixture.

The formation or physical ripening of silver halide grains may be carried out in the presence of cadmium salts, zinc salts, lead salts, thallium salts, iridium salts or its complex salts, rhodium salts or its complex salts, iron salts or its complex salts, and the like.

Silver halide emulsions are usually chemically sensitized. For this chemical sensitization, for example, the methods as described in H. Frieser ed., *Die Grundlagen Der Photographischen Prozesse mit Silberhalogeniden,* Akademische Verlagsgesellshaft, pages 675 to 734 (1968) can be used. Namely, a sulfur sensitization process using active gelatin or sulfur containing-compounds (e.g., thiosulfates, thioureas, mercapto compounds and rhodanines) capable of reacting with silver; a reduction sensitization process using reducing substances (e.g., stannous salts, amines, hydrazine derivatives, formamidinesulfinic acid, and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in this invention may include various compounds for the purpose of preventing fog formation or of stabilizing photographic performance in the photographic material during the production, storage or photographic processing thereof. For example, those compounds known as antifoggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particularly 4-hydroxy-substituted(1,3,3*a*7)tetraazaindenes), pentaazaindenes, etc.; benzenethiosulfonic acids; benzenesulfinic acids; benzenesulfonic amides; etc.

The photographic emulsion layers or other hydrophilic colloid layers of the photographic material of this invention may include various surface active agents as coating aids or for other various purposes, e.g., prevention of charging, improvement of slipping properties, acceleration of emulsification and dispersion, prevention of adhesion, and improvement of photographic characteristics (for example, development acceleration, high contrast, and sensitization), etc.

Yellow filter used in the color photographic material of this invention may be colloidal silver conventionally used. Alternatively, there may be used a yellow colored magenta coupler and/or a yellow, diffusion resistant organic dye. In this invention, there can be used known yellow colored magenta couplers, preferred examples of which are illustrated as follows.

YD-1

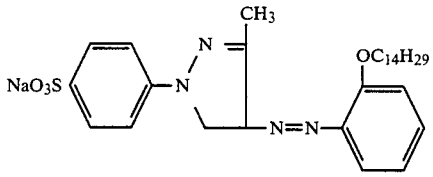

YD-2

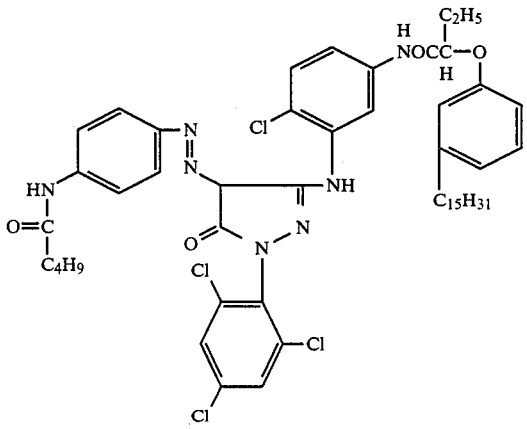

YD-2'

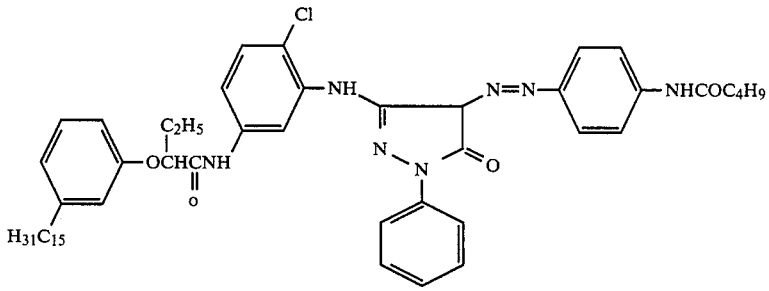

The yellow colored magenta couplers may be incorporated in a yellow filter by known methods for the incorporation of a coupler in a silver halide emulsion layer as described earlier.

In this invention, there can be used a yellow, diffusion resistant organic dye selected from known ones, preferred examples of which are illustrated as follows.

YD-3

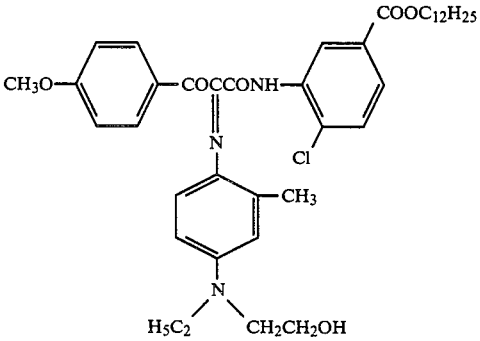

-continued

YD-4

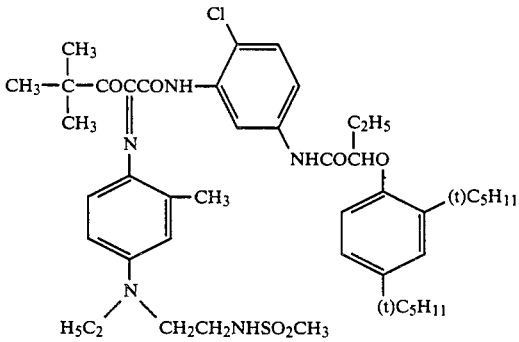

YD-5

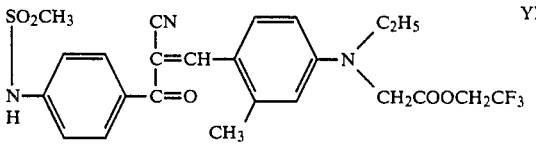

-continued

YD-6

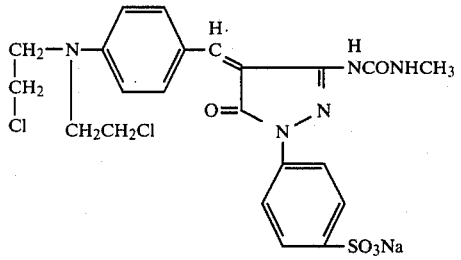

YD-7

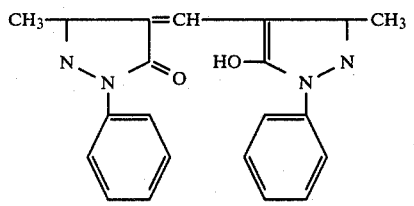

YD-8

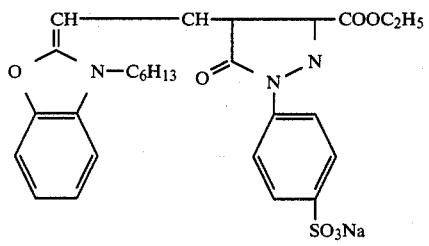

YD-9

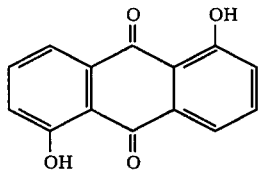

YD-10

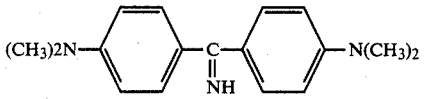

YD-11

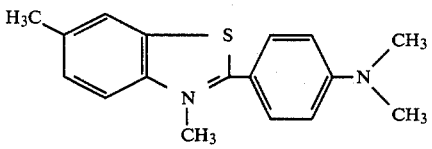

Yellow filters using organic dyes may be prepared in a known manner. Thus, if an oil-soluble organic dye is used, the method for the incorporation of yellow colored magenta couplers described earlier can be applied and if a water-soluble organic dye is used, it is incoporated in a hydrophilic colloid in the form of an aqueous solution or an aqueous alkaline solution. The method for the preparation of yellow filter layers used in this invention is similar to the method in which colloidal silver is used. The amounts of colloidal silver, yellow colored magenta couplers and organic dyes can be controlled so as to obtain a desired optical density.

The photographic material of this invention may include an ultraviolet light absorber in the hydrophilic colloid layer. Examples of the ultraviolet light absorber include aryl substituted benzotriazoles as described in U.S. Pat. Nos. 3,553,794 and 4,236,013, Japanese Patent Publication No. 51-6540 and European Pat. No. 57,160; butadienes as described in U.S. Pat. Nos. 4,450,229 and 4,195,999; cinnamic acid esters as described in U.S. Pat. Nos. 3,705,805 and 3,707,375; benzophenones as described in U.S. Pat. No. 3,215,530 and British Pat. No. 1,321,355; polymers having an ultraviolet light absorber residue as described in U.S. Pat. Nos. 3,761,272 and 4,431,726. There can also be used fluorescent whitening agents having an ability of ultraviolet light absorption as described in U.S. Pat. Nos. 3,499,762 and 3,700,455. Typical examples of ultraviolet light absorber are described in Research Disclosure No. 24239 (June, 1984), etc.

In photographic processing of the photographic material of this invention, any of known procedures and known processing solutions, e.g., those described in *Research Disclosure,* No. 176, pages 28 to 30 can be used. The processing temperature is usually chosen from between 18° C. and 50° C., although it may be lower than 18° C. or higher than 50° C.

Any fixing solutions which have compositions generally used can be used in this invention. As fixing agents, thiosulfuric acid salts and thiocyanic acid salts, and in addition, organic sulfur compounds which are known to be effective as fixing agents can be used. These fixing solutions may contain water-soluble aluminum salts as hardeners.

Color developing solutions are usually alkaline aqueous solutions containing color developing agents. As these color developing agents, there can be used known primary aromatic amine developing agents, e.g., phenylenediamines such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.

In addition, the compounds as described in L. F. A. Mason, *Photographic Processing Chemistry,* Focal Press, pages 226 to 229 (1966), U.S. Pat. Nos. 2,193,015 and 2,592,364, Japanese Patent Application (OPI) No. 48-64933, etc., may be used.

The color developing solutions can further contain pH buffering agents such as sulfites, carbonates, borates and phosphates of alkali metals, etc. developing restrainers or anti-fogging agents such as bromides, iodides or organic anti-fogging agents, etc. In addition, if desired, the color developing solutions can also contain water softeners; preservatives such as hydroxylamine, etc.; organic solvents such as benzyl alcohol, diethylene glycol, etc.; development accelerators such as polyethylene glycol, quaternary ammonium salts, amines, etc.; dye forming couplers; competing couplers; fogging agents such as sodium borohydride, etc.; auxiliary developing agents such as 1-phenyl-3-pyrazolidone, etc.; viscosity-imparting agents; polycarboxylic acid type chelating agents; anti-oxidizing agents; and the like.

After color development, the photographic emulsion layer is usually bleached. This bleach processing may be performed simultaneously with a fix processing, or they may be performed independently.

Bleaching agents which can be used include compounds of polyvalent metals, e.g., iron (III), cobalt (III), chromium (VI), and copper (II), peracids, quinones and nitroso compounds. For example, ferricyanides; dichromates; organic complex salts of iron (III) or cobalt (III), e.g., complex salts of aminopolycarboxylic acids (e.g., ethylenediaminetetraacetic acid, nitrilotriacetic acid, 1,3-diamino-2-propanoltetraacetic acid, etc.) or complex salts of organic acids (e.g., citric acid, tartaric acid, malic acid, etc.); persulfates; permanganates; nitrosophenol, etc. can be used. Of these compounds, potassium ferricyanide, iron (III) sodium ethylenediaminetetraacetate, and iron (III) ammonium ethylenediaminetetraacetate are particularly useful. Ethylenediaminetetraacetic acid iron (III) complex salts are useful in both an independent bleaching solution and a monobath bleach-fixing solution.

The photographic material of this invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), and mucohalogenic acids (e.g., mucochloric acid, mucophenoxychloric acid, etc.) can be used alone or in combination with each other.

In the photographic material of this invention, when dyes, ultraviolet light absorbing agents, and the like are incorporated in the hydrophilic colloid layers, they may be mordanted with cationic polymers, etc.

The photographic material of this invention may contain hydroquinone derivatives, aminophenol derivatives, gallic acid derivatives, ascorbic acid derivatives, etc., as color fog preventing agents.

The photographic material of this invention may contain water-soluble dyes in the hydrophilic colloid layers thereof as filter dye or for various purposes, e.g., irradiation prevention. Examples of such dyes include oxonol dyes, hemioxonol dyes, styryl dyes, merocyanine dyes, cyanine dyes, and azo dyes.

When the color negative film obtained by the photographic process of the photographic material of this invention is used to produce a color print, it is desirable to use as a color paper for the print color photographic materials which comprise as a magenta coupler pyrazolo[5.1-c][1,2,4]triazoles as described in U.S. Pat. No. 3,725,067, imidazo[1,2-b]pyrazoles as described in U.S. Pat. No. 4,500,630 or pyrazolo[1,5-b][1,2,4]triazoles as described in European Pat. No. 119,860A.

This invention will now be explained in more detail with reference to the following Examples to which this invention is not limited.

EXAMPLE 1

SAMPLE 1 (Comparative Example)

On a cellulose triacetate film support, there was prepared a multilayer color photographic material (Sample 101) consisting of the following layers. The first layer is nearest the film support.

| | |
|---|---|
| 1st layer: Antihalation layer | |
| Black colloidal silver (the amount of silver coated) | 0.2 g/m$^2$ |
| Gelatin | 1.3 g/m$^2$ |
| UV-1 (ultraviolet ray absorber) | 0.1 g/m$^2$ |
| UV-2 (ultraviolet ray absorber) | 0.2 g/m$^2$ |
| OIL-1 (dispersing oil) | 0.01 g/m$^2$ |
| OIL-2 (dispersing oil) | 0.01 g/m$^2$ |
| 2nd layer: Interlayer | |
| Fine grain size silver halide (AgBr: average grain size of 0.07 micron) (the amount of silver coated) | 0.15 g/m$^2$ |
| Gelatin | 1.0 g/m$^2$ |
| C-1 (colored coupler) | 0.1 g/m$^2$ |
| C-2 (colored coupler) | 0.01 g/m$^2$ |
| OIL-1 | 0.1 g/m$^2$ |
| 3rd layer: First red-sensitive layer | |
| Silver bromoiodide emulsion (average grain size of 0.3 micron, AgBrI containing 3 mole % AgI)(the amount of silver coated) | 1.5 g/m$^2$ |
| Gelatin | 1.5 g/m$^2$ |
| P-1 (sensitizing dye) per mole of silver | $4.5 \times 10^{-4}$ mole |
| P-2 (sensitizing dye) per mole of silver | $1.5 \times 10^{-4}$ mole |
| C-3 (coupler) | 0.5 g/m$^2$ |
| C-4 (DIR coupler) | 0.02 g/m$^2$ |
| C-2 | 0.03 g/m$^2$ |
| OIL-1 | 0.12 g/m$^2$ |
| OIL-2 | 0.12 g/m$^2$ |
| 4th layer: Second red-sensitive layer | |
| Silver bromoiodide emulsion (average grain size of 0.7 micron, AgBrI containing 6 mole % of AgI)(the amount of silver coated) | 1.0 g/m$^2$ |
| Gelatin | 1.0 g/m$^2$ |
| P-1 per mole of silver | $3 \times 10^{-4}$ mole |
| P-2 per mole of silver | $1 \times 10^{-4}$ mole |
| C-5 | 0.07 g/m$^2$ |
| C-2 | 0.01 g/m$^2$ |
| OIL-1 | 0.01 g/m$^2$ |
| OIL-2 | 0.01 g/m$^2$ |
| 5th layer: Interlayer | |
| Gelatin | 1 g/m$^2$ |
| C-6 | 0.03 g/m$^2$ |
| OIL-1 | 0.05 g/m$^2$ |
| OIL-2 | 0.05 g/m$^2$ |
| 6th layer: First green-sensitive layer | |
| Silver bromoiodide emulsion (average grain size of 0.3 micron, AgBrI containing 4 mole % AgI)(the amount of silver coated) | 0.08 g/m$^2$ |
| Gelatin | 1.0 g/m$^2$ |
| O-1 (sensitizing dye) per mole of silver | $5 \times 10^{-4}$ mole |
| O-2 (sensitizing dye) per mole of silver | $2 \times 10^{-4}$ mole |
| C-7 (coupler) | 0.4 g/m$^2$ |
| C-8 (DIR coupler) | 0.06 g/m$^2$ |
| C-1 | 0.15 g/m$^2$ |
| OIL-1 | 0.5 g/m$^2$ |
| 7th layer: Second green-sensitive layer | |
| Silver bromoiodide emulsion (average grain size of 0.7 micron, AgBrI containing 6 mole % AgI)(the amount of silver coated) | 1.0 g/m$^2$ |
| Gelatin | 1.0 g/m$^2$ |
| O-1 per mole of silver | $3.5 \times 10^{-4}$ mole |
| O-2 per mole of silver | $1.4 \times 10^{-4}$ mole |
| C-7 | 0.08 g/m$^2$ |
| C-1 | 0.02 g/m$^2$ |
| OIL-1 | 0.10 g/m$^2$ |
| 8th layer: Yellow filter layer | |
| Yellow colloidal silver (the amount of silver coated) | 0.04 g/m$^2$ |
| Gelatin | 1.0 g/m$^2$ |
| C-6 | 0.1 g/m$^2$ |
| OIL-1 | 0.3 g/m$^2$ |
| 9th layer: First blue-sensitive layer | |
| Silver bromoiodide emulsion (average grain size of 0.3 micron, AgBrI containing 4 mole % AgI)(the amount of silver coated) | 0.5 g/m$^2$ |
| Gelatin | 1.0 g/m$^2$ |
| O-3 (sensitizing dye) per mole of silver | $2 \times 10^{-4}$ mole |
| C-9 (coupler) | 0.7 g/m$^2$ |
| C-5 (coupler) | 0.2 g/m$^2$ |
| C-10 (DIR coupler) | 0.07 g/m$^2$ |

-continued

| | |
|---|---|
| OIL-1 | 0.2 g/m$^2$ |
| 10th layer: Second blue-sensitive layer | |
| Silver bromoiodide emulsion (average grain size of 1.5 microns, AgBrI containing 10 mole % AgI)(the amount of silver coated) | 0.5 g/m$^2$ |
| Gelatin | 0.6 g/m$^2$ |
| O-3 per mole of silver | $1 \times 10^{-4}$ mole |
| C-9 | 0.25 g/m$^2$ |
| OIL-1 | 0.07 g/m$^2$ |
| 11th layer: First protective layer | |
| Gelatin | 1.5 g/m$^2$ |
| UV-1 (ultraviolet ray absorber) | 0.1 g/m$^2$ |
| UV-2 (ultraviolet ray absorber) | 0.2 g/m$^2$ |
| OIL-1 | 0.01 g/m$^2$ |
| OIL-2 | 0.01 g/m$^2$ |
| 12th layer: Second protective layer | |
| Fine grain size silver halide (AgBr having average grain size of 0.07 micron)(the amount of silver coated) | 0.5 g/m$^2$ |
| Polymethylmethacrylate particles (diameter of about 1.5 microns) | 0.2 g/m$^2$ |
| H-1 (hardener) | 0.4 g/m$^2$ |
| S-1 (formaldehyde scavenger) | 1 g/m$^2$ |

SAMPLE 2 (This invention)

The same as Sample 1 except for the following modification.

(1) Remove the DIR coupler C-8 from the 6th layer.

(2) Provide a third green-sensitive layer of the following composition between the 6th and the 7th layers.

| | |
|---|---|
| Silver bromoiodide emulsion (average grain size of 0.7 micron, AgBrI containing 6 mole % AgI)(the amount of silver coated) | 1.0 g/m$^2$ |
| Gelatin | 1.0 g/m$^2$ |
| O-3 per mole of silver | $5 \times 10^{-4}$ mole |
| C-7 | 0.2 g/m$^2$ |
| C-11 (DIR coupler) | 0.12 g/m$^2$ |
| OIL-1 | 0.2 g/m$^2$ |

(3) Increase the amount of the composition of the 3rd layer by 1.2 times.

SAMPLE 103 (Comparative Example)

The same as Sample 101 except for the following modification.

(1) Remove the DIR coupler C-8 of the 6th layer.

(2) Provide a third green-sensitive layer of the following composition between the 6th and the 7th layers.

| | |
|---|---|
| Silver bromoiodide emulsion (average grain size of 0.5 micron, AgBrI containing 6 mole % AgI)(the amount of silver coated) | 1.0 g/m$^2$ |
| Gelatin | 1.0 g/m$^2$ |
| O-1 per mole of silver | $3.5 \times 10^{-4}$ mole |
| O-2 per mole of silver | $1.4 \times 10^{-4}$ mole |
| C-7 | 0.2 g/m$^2$ |
| C-11 | 0.12 g/m$^2$ |
| OIL-1 | 0.2 g/m$^2$ |

(3) Increase the amount of the composition of the 3rd layer by 1.2 times.

SAMPLE 104 (This invention)

The same as Sample 101 except for the following modification.

(1) Remove the DIR coupler C-8 of the 6th layer.

(2) Provide a third green-sensitive layer of the following composition betwen the 6th and the 7th layers.

| | |
|---|---|
| Silver bromoiodide (average grain size of 0.7 micron, AgBrI containing 6 mole % AgI)(the amount of silver coated) | 1.0 g/m$^2$ |
| Gelatin | 1.0 g/m$^2$ |
| O-3 per mole of silver | $5 \times 10^{-4}$ mole |
| C-7 | 0.2 g/m$^2$ |
| C-8 | 0.12 g/m$^2$ |
| OIL-1 | 0.2 g/m$^2$ |

SAMPLE 105 Comparative Example

The same as Sample 102 except that the magenta coupler C-7 of the third green-sensitive layer thereof was removed.

SAMPLE 106 (This invention)

The same as Sample 102 except that the sensitizing dye O-3 of the third green-sensitive layer thereof was replaced by the sensitizing dye O-1 of $3 \times 10^{-4}$ mole per mole of silver.

SAMPLE 107 (comparative Example)

The same as Sample 102 except that the sensitizing dye O-3 of the third green-sensitive layer thereof was replaced by the sensitizing dye O-2 of $4 \times 10^{-4}$ mole per mole of silver.

Samples 101 to 107 were exposed to white light through an optical wedge, followed by color development which was carried out at 38° C. according to the following procedures.

| | | |
|---|---|---|
| 1. | Color development | 3 min. 15 sec. |
| 2. | Bleaching | 6 min. 30 sec. |
| 3. | Water washing | 3 min. 15 sec. |
| 4. | Fixing | 6 min. 30 sec. |
| 5. | Water washing | 3 min. 15 sec. |
| 6. | Stabilizing | 3 min. 15 sec. |

The compositions of the processing liquids used in the steps were as follows.

| | |
|---|---|
| Color developing solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—ethyl-N—beta-hydroxyethylamino) -2-methylaniline sulfate | 4.5 g |
| Water to | 1.0 l |
| Bleaching solution | |
| Ammonium bromide | 160.0 g |
| Ammonia water (28%) | 25.0 ml |
| Ethylenediaminetetraacetic acid ferric sodium salt | 130.0 g |
| Glacial acetic acid | 14.0 ml |
| Water to | 1.0 l |
| Fixing solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to | 1.0 l |
| Stabilizing solution | |
| Formalin | 8.0 ml |

-continued

| | |
|---|---|
| Water to | 1.0 l |

According to the equations described earlier, $\overline{\lambda}_G$ and $\overline{\lambda}_{-R}$ of Samples 101 to 107 were calculated. The differences $\overline{\lambda}_G-\overline{\lambda}_{-R}$ were found as follows.

| SAMPLE | $\overline{\lambda}_G$ (nm) | $\overline{\lambda}_{-R}$ (nm) | $\overline{\lambda}_G-\overline{\lambda}_{-R}$ (nm) |
|---|---|---|---|
| 101 (Comparative Example) | 548 | 545 | 3 |
| 102 (This invention) | 550 | 525 | 25 |
| 103 (Comparative Example) | 548 | 547 | 1 |
| 104 (This invention) | 549 | 523 | 26 |
| 106 (This invention) | 549 | 541 | 8 |
| 107 (Comparative Example) | 548 | 559 | −11 |

Sensitometry was conducted for these SAMPLES using a Status M Filter produced by Macbeth. All the samples gave almost the same sensitivity and gradation except that the green-sensitive layer of Sample 105 was too low in sensitivity and soft in tone for practical use.

Figure 3:
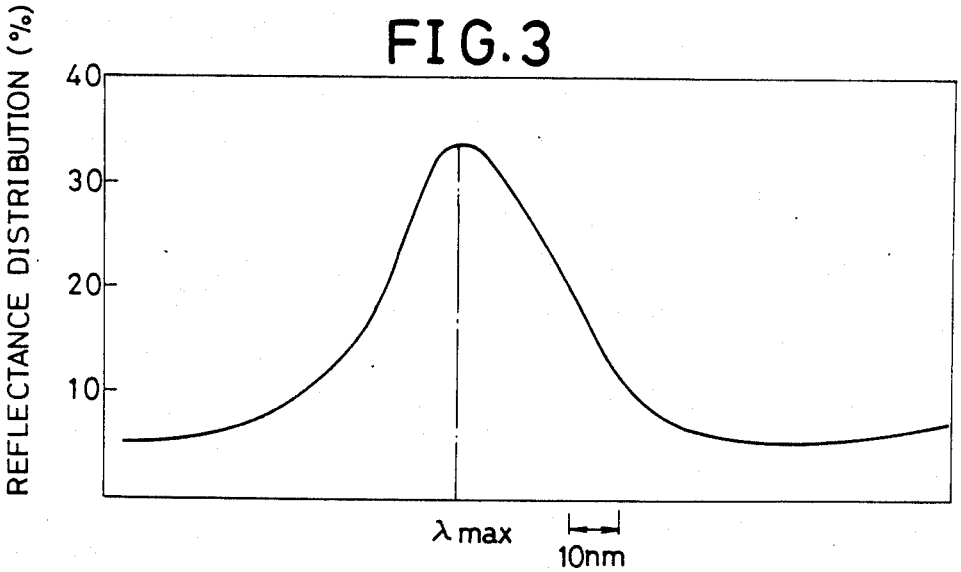
FIG. 3 shows a graph of a reflectance distribution (%) (ordinate) of a green color chart plotted against wavelength (abscissa) in nanometer (nm.) units.

All the samples were processed to Leica size for camera photography and used to photograph various charts of green colors having spectral reflectance as shown in FIG. 3 and peak wavelength ($\lambda_{max}$) of 470 nm to 580 nm. Speed was set as ISO 50. After photographing, the photographic processings as described earlier were conducted to obtain negative films which were subsequently used to print on color papers produced by FUJI PHOTO FILM so that gray color simultaneously photographed was reproduced. Cyan densities on the prints corresponding to the green color charts were measured by a Status A Filter produced by Macbeth.

Separately, there were determined cyan color densities on the color papers necessary to reproduce the same green colors as those of the charts. These cyan color densities were plotted against the $\lambda_{max}$ of the charts to obtain a standard color reproduction curve represented by a solid thick line on FIG. 4.

Figure 4:
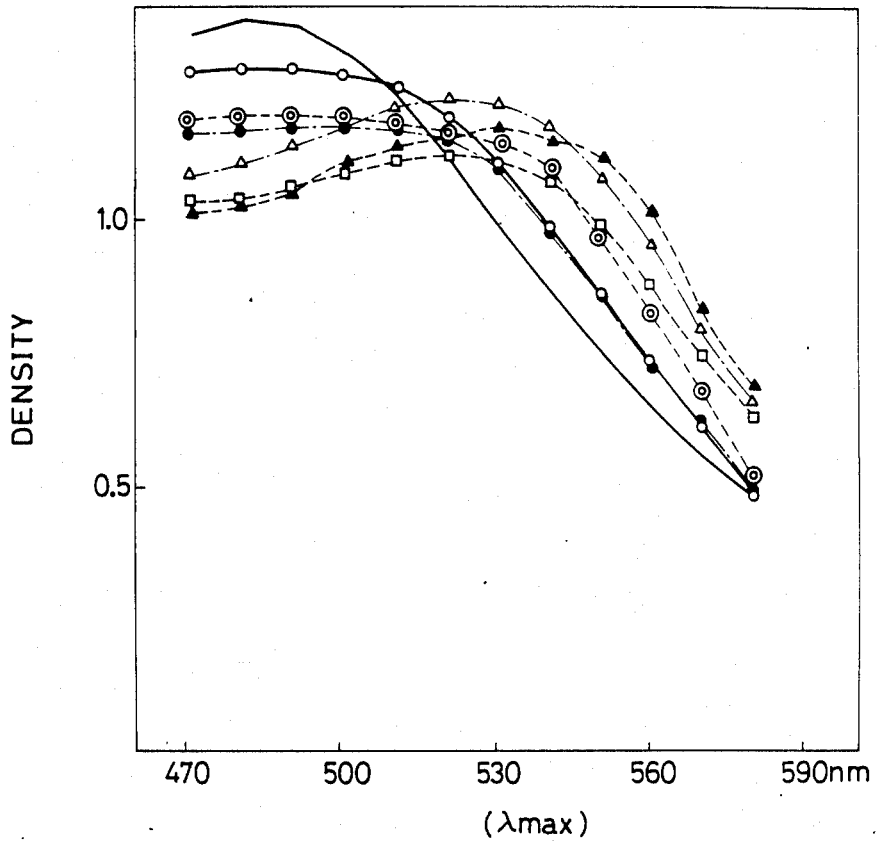
FIG. 4 shows curves of cyan density in a color paper necessary for the color reproduction of a green color chart having a specific $\lambda_{max}$ plotted against the $\lambda_{max}$.

FIG. 4 shows the following.

(1) Comparative Sample 101 showed cyan deficient color reproduction to a subject of cyangreen color having $\lambda_{max}$ of 520 nm or less, while it showed cyan excess color reproduction to a subject of green to brown color having $\lambda_{max}$ of 520 nm or more, and therefore it was not faithful.

(2) Comparative Sample 103 was modified to increase the interlayer effect from the green-sensitive layer to the red-sensitive layer so as to improve the color reproduction of red colors as well as to increase cyan densities of green colors as compared with Sample 101 and $\overline{\lambda}_G-\overline{\lambda}_{-R}$ of Sample 103 was less than 5 nm. As a result, Sample 103 showed increased cyan density and good color reproduction to a subject of cyan-green color having $\lambda_{max}$ of 510 nm or less but it showed more cyan excess color reproduction to a subject of color having $\lambda_{max}$ of 520 nm or more as compared with Sample 101.

(3) Comparative Sample 107 showed cyan-deficient color reproduction to a subject of cyangreen color having $\lambda_{max}$ of 510 nm or less, while it showed more cyan-excess color reproduction to a subject of cyan-green color having $\lambda_{max}$ of 520 nm or more as compared with Sample 101, and therefore it showed the worst color reproduction.

(4) Sample 102 of this invention showed, as compared with Comparative Samples 101 and 103, increased cyan density to a subject of colors having $\lambda_{max}$ of 500 nm or less and decreased cyan density to a subject of colors having $\lambda_{max}$ of 530 nm or more. As a result, it showed a good color reproduction in the whole spectrum region and its curve became nearer to the standard one.

(5) Sample 104 of this invention also showed, as compared with Comparative Samples 101 and 103, a good color reproduction but it showed a worse color reproduction to a subject of colors having $\lambda_{max}$ of 510 nm or less, than Sample 102 because the diffusibility of the coupling off group released from the DIR coupler added to the third green-sensitive layer of Sample 104 is small, and therefore it effects smaller interlayer effect on the red-sensitive layer.

(6) Sample 106 of this invention showed, like Sample 102, a good color reproduction, i.e. its curve became nearer to the standard one.

In the same manner as described above, Samples 101 to 107 were used to photograph a color rendition chart produced by Macbeth under radiation of color temperature of 5500° K. The resulting negative films were used to print on color papers produced by FUJI PHOTO FILM so as to reproduce the original gray color having a reflectance of 18%. The results as shown in the following table showed that Samples of this invention gave a good color reproduction of violet colors and blueflower colors.

| SAMPLE Nos. | $\overline{\lambda}_G-\overline{\lambda}_{-R}$ | Diffusibilities of compounds released from DIR couplers incorporated in the third green layer | Magenta forming coupler in the third green layer | Evaluation* of violet color reproduction | | |
|---|---|---|---|---|---|---|
| | | | | Hue | Saturation | Total |
| 101 (Comparative Example) | 3 | — | — | 5 | 2 | 7 |
| 102 (This invention) | 25 | 0.74 | Yes | 5 | 5 | 10 |
| 103 (Comparative Example) | 1 | 0.74 | Yes | 2 | 5 | 7 |
| 104 (This invention) | 26 | 0.20 | Yes | 5 | 4 | 9 |
| 105 (Comparative Example) | 26 | 0.74 | No | — | — | — |
| 106 (This invention) | 8 | 0.74 | Yes | 4 | 5 | 9 |
| 107 (Comparative Example) | −11 | 0.74 | Yes | 2 | 5 | 7 |

*Evaluation was made by ten panelists who rated Hue and Saturation on a basis of 1 to 5 points.
best . . . 5
good . . . 4
medium . . . 3
bad . . . 2
worst . . . 1

EXAMPLE 2

Sample 105 was modified as follows to prepare SAMPLE 108.

(1) Increase the amount of each of the compositions of the first green-sensitive layer by 1.3 times.
(2) Increase the amount of each of the compositions of the second green-sensitive layer by 1.1 times.

Sample 108 was subjected to sensitometric exposure to obtain a color negative film with sensitivity and gradation almost equal to those of Sample 102. Spectral sensitivity distributions $S_G(\lambda)$ of the green-sensitive layers of Samples 101, 102 and 108 were obtained. The results are shown in FIG. 5.

The spectral sensitivity distribution of Sample 102 is nearly identical with that of Sample 101. The spectral sensitivity of Sample 108 is increased in the range of 500 nm to 540 nm because of the interlayer effect from the third green-sensitive layer. This means that the decrease in the spectral sensitivity in this range could not be compensated for by the increase in the coating amount of the first and the second green-sensitive layers. It is therefore evident that the third green-sensitive layer must form a magenta color in order to maintain the desired spectral sensitivity distribution of the green-sensitive layer.

Modular transfer function (referred to as MTF) of the green-sensitive layers of Samples 101, 102 and 108 were measured at a frequency of ten pairs per millimeter. The results are as follows.

| SAMPLE Nos. | MTF (10 pairs/mm) |
|---|---|
| 101 | 0.90 |
| 102 | 1.08 |
| 108 | 0.96 |

From the results, it is apparent that a third green-sensitive layer must form a magenta color in order to improve image sharpness of the green-sensitive layer.

The compounds used in Examples above are as follows:

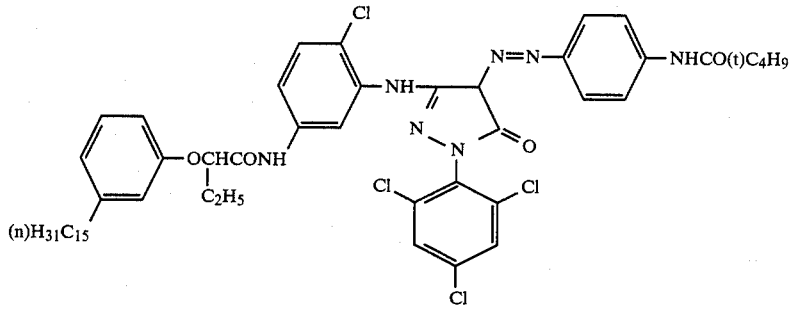

C-1

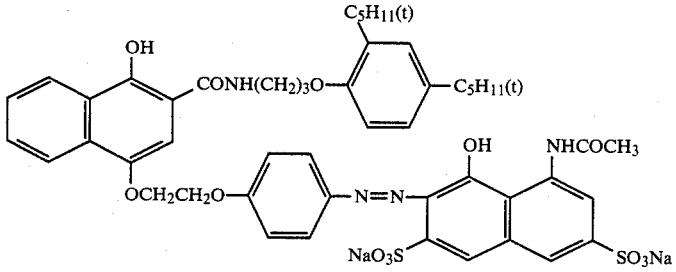

C-2

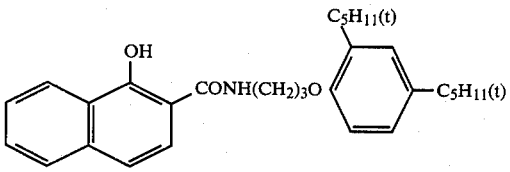

C-3

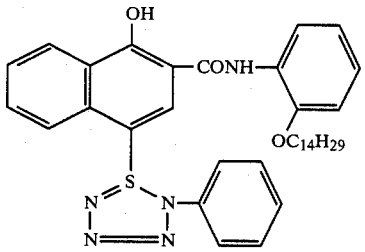

C-4

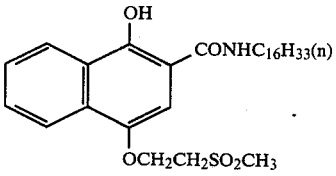

C-5

2,5-Di-t-pentadecylhydroquinone C-6

-continued
C-7
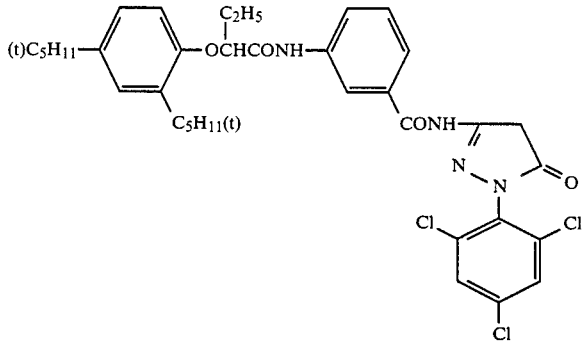
C-8
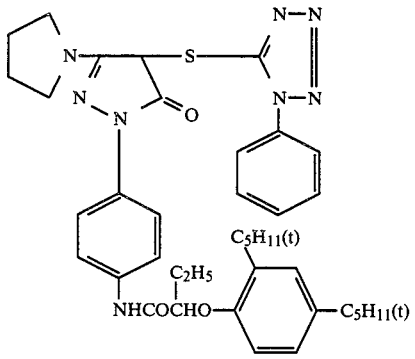
C-9
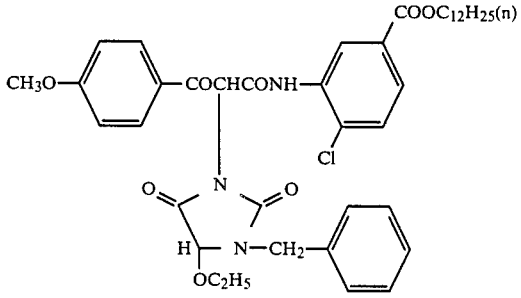
C-10
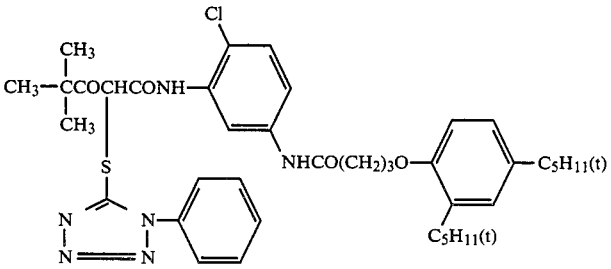
C-11
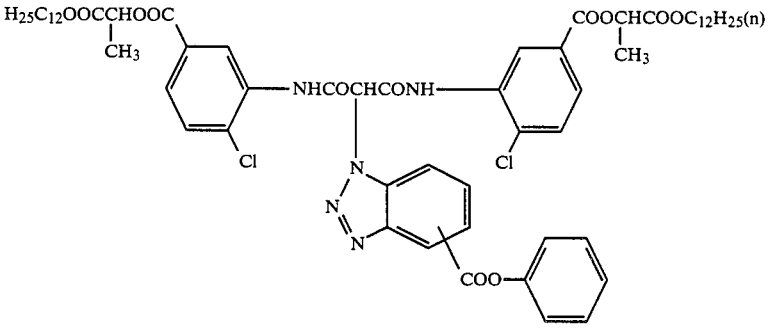
P-1
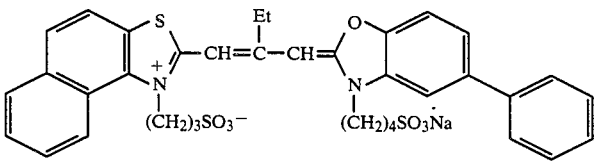

-continued

P-2

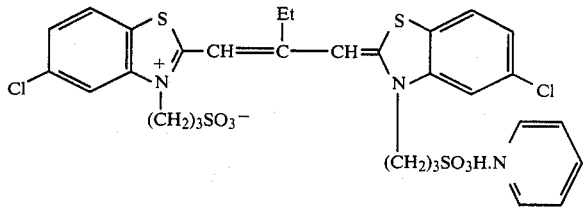

O-1

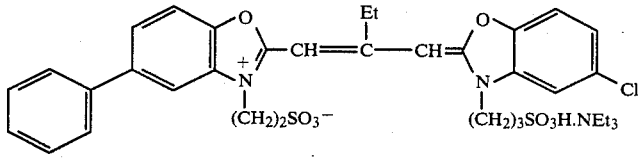

O-2

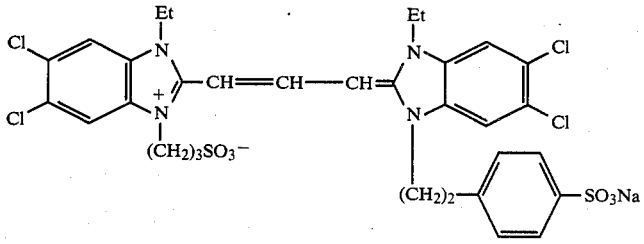

O-3

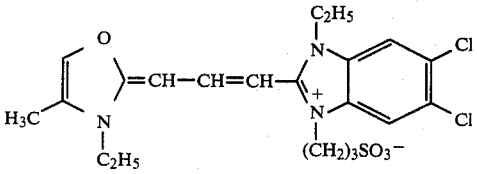

UV-1

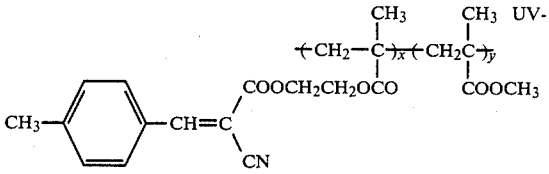

x/y = 7/3 (by weight)

UV-2

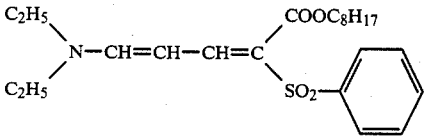

Tricresylphosphate

OIL-1

OIL-2

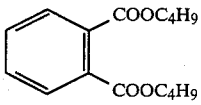

H-1

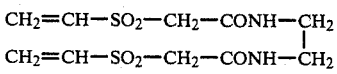

S-1

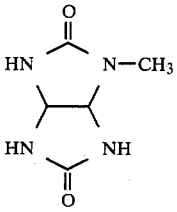

What we claim is:

1. A silver halide color photographic material comprising a support having thereon at least one blue-sensitive silver halide emulsion layer comprising a yellow dye-forming coupler, at least one green-sensitive silver halide emulsion layer comprising a magenta dye-forming coupler, and at least one red-sensitive silver halide emulsion layer comprising a cyan dye-forming coupler, characterized in that the wavelength ($\bar{\lambda}_G$) weight-averaged between 500 nm and 600 nm of spectral sensitivity distribution of all green-sensitive layers is located in the range of 520 nm to 580 nm, the wavelength ($\bar{\lambda}_{-R}$) weight-averaged between 500 nm and 600 nm of spectral sensitivity distribution of one or more donor layers which exert an interlayer effect to at least one red-sensitive emulsion layer comprising a cyan dye-forming coupler is located in the range of 500 nm to 560 nm, ($\bar{\lambda}_G$) is greater than ($\bar{\lambda}_{-R}$), and the difference of ($\bar{\lambda}_G - \bar{\lambda}_{-R}$) is greater than 5 nm:

wherein said weight-averaged wavelength ($\bar{\lambda}_G$) is defined by the following equation:

$$\bar{\lambda}_G = \frac{\int_{500\text{ nm}}^{600\text{ nm}} \lambda \cdot S_G(\lambda)\, d\lambda}{\int_{500\text{ nm}}^{600\text{ nm}} S_G(\lambda)\, d\lambda}$$

wherein $S_G(\lambda)$ represents said spectral sensitivity distribution by equi-energy spectrum of all green-sensitive layers, and said weight-averaged wavelength ($\bar{\lambda}_{-R}$) is defined by the following equation:

$$\bar{\lambda}_{-R} = \frac{\int_{500\,nm}^{600\,nm} \lambda \cdot S_{-R}(\lambda)\, d\lambda}{\int_{500\,nm}^{600\,nm} S_{-R}(\lambda)\, d\lambda}$$

wherein $S_{-R}(\lambda)$ represents the spectral sensitivity distribution of said one or more donor layers.

2. A silver halide color photographic material as claimed in claim 1, wherein said blue-sensitive, green-sensitive and red-sensitive silver halide emulsions are negative-working.

3. A silver halide color photographic material as claimed in claim 1, wherein after color development processing only a negative color dye image is formed.

4. A silver halide color photographic material as claimed in claim 1, wherein said one or more donor layers comprise at least one DIR coupler which releases a development restrainer or a precursor thereof having high diffusibility.

5. A silver halide color photographic material as claimed in claim 4, wherein said development restrainer or the precursor thereof has a diffusibility of 0.4 or more.

6. A silver halide color photographic material as claimed in claim 4, wherein said development restrainer or the precursor thereof has a diffusibility of 0.6 or more.

7. A silver halide color photographic material as claimed in claim 4, wherein said one or more DIR couplers are selected from the compounds represented by the formula (I):

$$J\text{-}(Y)h \qquad (I)$$

wherein J represent a coupler component, h is an integer of 1 or 2 and Y represents a coupling-off group which is linked to a coupling position of the coupler component J and can be eliminated from the coupler component upon the reaction with the oxidation products of a color developer to form a highly diffusible development restrainer or a precursor thereof.

8. A silver halide color photographic material as claimed in claim 7, wherein Y is a group represented by the formula (II), (III), (IV) or (V):

(II)

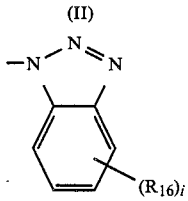

(III)

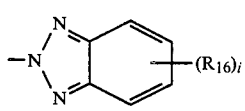

(IV)

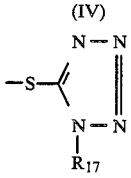

(V)

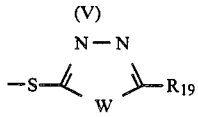

wherein W represent —S— or —N($R_{18}$)—, $R_{16}$, $R_{17}$, $R_{18}$ and $R_{19}$ each represents a group selected from a hydrogen atom, a bromine atom, an amino group, —R′, —NHCOR′, —$NHSO_2R'$, —OR′, —$CO_2R'$ and —NHR′ wherein R′ represents an aliphatic hydrocarbon group (substituted or not) having 1 to 8 carbon atoms or a phenyl group (substituted or not), $R_{16}$, $R_{17}$, $R_{18}$ and $R_{19}$ each is a group selected so that the development restrainer released from the compound of the formula (I) has a diffusibility of 0.4 or more, and i represents an integer of 1 to 4.

9. A silver halide color photographic material as claimed in claim 8, wherein Y is a group represented by the formula (II):

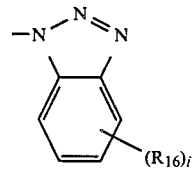

(II)

wherein $R_{16}$ is a group selected so that Y has a diffusibility of 0.4 or more, and i represents an integer of 1 to 4.

10. A silver halide color photographic material as claimed in claim 8, wherein Y is a group represented by the formula (IV):

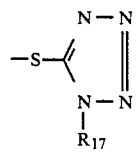

(IV)

wherein $R_{17}$ is a group selected so that Y has a diffusibility of 0.4 or more.

11. A silver halide color photographic material as claimed in claim 10, wherein Y is a group represented by the formula (IV), wherein $R_{17}$ is a lower alkyl group having 1 to 4 carbon atoms.

12. A silver halide color photographic material as claimed in claim 1, wherein said one or more donor layers which exert an interlayer effect to at least one red-sensitive emulsion layer comprising a cyan dye forming-coupler comprise one or more uncolored coupler selected from a magenta dye-forming coupler or a yellow dye-forming coupler which yellow or magenta dyes are not capable of being washed out nor capable of being destroyed during the development processing.

13. A silver halide color photographic material as claimed in claim 1, wherein $\bar{\lambda}_{-R}$ is in the range of 500 nm to 550 nm.

14. A silver halide color photographic material as claimed in claim 1, wherein the difference $(\bar{\lambda}_G - \bar{\lambda}_{-R})$ is 10 nm or more.

15. A silver halide color photograhic material as claimed in claim 1, wherein the difference $(\bar{\lambda}_G - \bar{\lambda}_{-R})$ is greater than 20 nm and smaller than 80 nm.

16. A silver halide color photographic material as claimed in claim 1, wherein said one or more donor layers are arranged between a yellow filter layer and said support.

17. A silver halide color photographic material as claimed in claim 1, wherein said one or more donor layers are arranged between a yellow filter layer and a high-speed red-sensitive layer.

18. A silver halide photographic material as claimed in claim 7, wherein said one or more DIR couplers are selected from compounds which release a development restraining moiety which is decomposed to a compound which does not substantially influence the photographic properties when the moiety diffuses into a color developing solution.

19. A silver halide color photographic material as claimed in claim 1, wherein an emulsion of said one or more donor layers is sensitized by a sensitizing dye having an absorption maximum of 500 to 550 nm.

20. A silver halide color photographic material as claimed in claim 1, wherein an emulsion of said one or more donor layers is sensitized by a sensitizing dye having an absorption maximum of 500 to 530 nm.

21. A silver halide color photographic material as claimed in claim 7, wherein J is a component of a coupler which produces a magenta dye or a yellow dye.

* * * * *